US007744087B2

(12) United States Patent
Tseng

(10) Patent No.: US 7,744,087 B2
(45) Date of Patent: Jun. 29, 2010

(54) AUTOMATIC DICE SHAKING APPARATUS

(76) Inventor: Tzu-Hsiang Tseng, 15F., No. 367, Sec. 4, Hankou Rd., North District, Taichung City (TW) 404

( * ) Notice: Subject to any disclaimer, the term of this patent is extended or adjusted under 35 U.S.C. 154(b) by 126 days.

(21) Appl. No.: 12/285,721

(22) Filed: Oct. 14, 2008

(65) Prior Publication Data

US 2010/0090399 A1 Apr. 15, 2010

(51) Int. Cl.
*A63F 9/04* (2006.01)

(52) U.S. Cl. ..... 273/145 C; 273/145 R; 273/145 A; 273/138.2; D21/372; 463/22

(58) Field of Classification Search ..... 273/145 C, 273/145 R, 145 A, 145 CA, 138.2; D21/372; 463/22

See application file for complete search history.

(56) References Cited

U.S. PATENT DOCUMENTS 491,971 A * 2/1893 Williams et al. ..... 194/276
1,054,694 A * 3/1913 Langworthy ..... 273/145 A
3,684,291 A * 8/1972 Johmann ..... 273/145 R
3,831,948 A * 8/1974 Suda ..... 273/145 R
4,807,883 A * 2/1989 Silverman ..... 273/145 C
5,259,618 A * 11/1993 Ramos ..... 273/145 C
7,185,889 B2 * 3/2007 VanZanten ..... 273/274
2007/0090595 A1 * 4/2007 Csikos ..... 273/149 R
2009/0036187 A1 * 2/2009 Tseng ..... 463/13
2009/0264186 A1 * 10/2009 Lai et al. ..... 463/22

OTHER PUBLICATIONS

Taiwan Fulgent Ent. Co., Ltd., RobotCasino, http://www.robotcasino.com.tw, brochure picked up at Global Gaming Expo, Las Vegas, NV on Sep. 13, 2005.*

* cited by examiner

*Primary Examiner*—Benjamin H Layno
(74) *Attorney, Agent, or Firm*—Bacon & Thomas, PLLC

(57) ABSTRACT

A automatic dice shaking apparatus that uses a mechanical arm to substitute for labor in performing dice cup and dice seat joining, dice shaking and dice cup opening actions automatically, improving game fairness and reducing the personnel cost.

21 Claims, 28 Drawing Sheets

AUTOMATIC DICE SHAKING APPARATUS

BACKGROUND OF THE INVENTION

1. Field of the Invention

The present invention relates to dice gambling and more particularly, to an automatic dice shaking apparatus.

2. Description of the Related Art

Dice are small objects, usually cubic, used for generating random numbers for use in tabletop games. Many dice games are known. In one known dice game, players bet on the banker, and the banker puts the dice in a dice box and shakes the dice. After betting, the banker opens the dice cup and pay the dividens subject to the gambling result.

However, performing dice games may encounter some problems as follows:

1. Because all actions (such as dice shaking, dice cup opening, and etc.) during a dice game are done manually, a dealer may control the points of the dice by means of a manipulation skill or have the points expected by the banker to appear by means of the control of the muscular strength of the hand shaking the dice. Therefore, a conventional manual dice shaking operation cannot prevent cheating, lacking objective fairness.

2. There are automatic dice shakers for shaking dice automatically to ensure game fairness. However, these automatic dice shakers cannot perform a dice cup opening procedure automatically. Because the opening of the dice cup must be performed manually, cheating may exist. Playing a dice game in this manner still lacks fairness.

3. Because a person is hired to shake the dice and to open the dice cup during a dice game, the personnel cost is relatively increased.

Therefore, it is desirable to provide an automatic dice shaking apparatus that eliminates the aforesaid problems.

SUMMARY OF THE INVENTION

The present invention has been accomplished under the circumstances in view. It is the main object of the present invention to provide an automatic dice shaking apparatus, which automatically shakes the dice and opens the dice cup by means of a computer-controlled mechanical arm, improving the game fairness.

It is another object of the present invention to provide an automatic dice shaking apparatus, which utilizes a computer-controlled mechanical arm to automatically shake the dice and open the dice cup instead of human labor, thereby lowering the personnel cost.

To achieve these and other objects of the present invention, the automatic dice shaking apparatus comprises: a positioning unit affixed to a plane, a dice seat for carrying a plurality of dice, the dice seat being detachably connectable to the positioning unit and prohibited from rotation relative to the positioning unit after connection, the dice seat being vertically movable relative to the positioning unit and separable from the positioning unit after connection between the dice seat and the positioning unit, a dice cup detachably connectable to the dice seat and defining with the dice seat an enclosed dice chamber, and a mechanical arm that has a mount affixed to the plane, the mechanical arm being operable to make lifting, rotation and swinging actions, the mechanical arm having a front end connectable to the dice cup for enabling the dice cup to be lifted, rotated and swung by the mechanical arm. The mechanical arm is operable to connect the dice cup and the dice seat together, and then to separate the dice seat with the dice cup from the positioning unit, and then to shake the dice seat and the dice cup, and then to couple the dice seat to the positioning unit, and then to separate the dice cup from the dice seat.

DETAILED DESCRIPTION OF THE INVENTION

Figure 1:
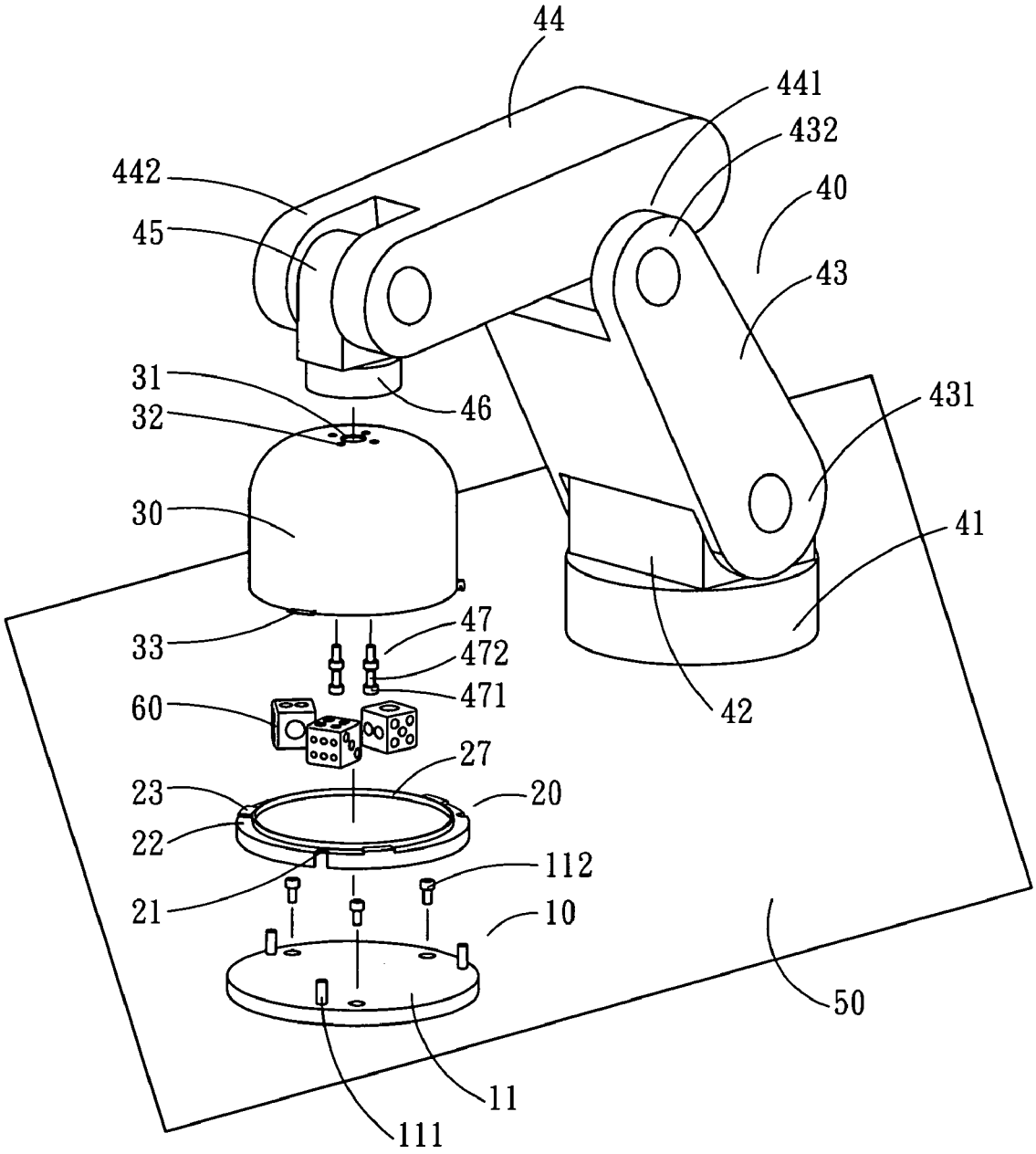
FIG. 1 is an exploded view of an automatic dice shaking apparatus in accordance with a first embodiment of the present invention.
Figure 2:
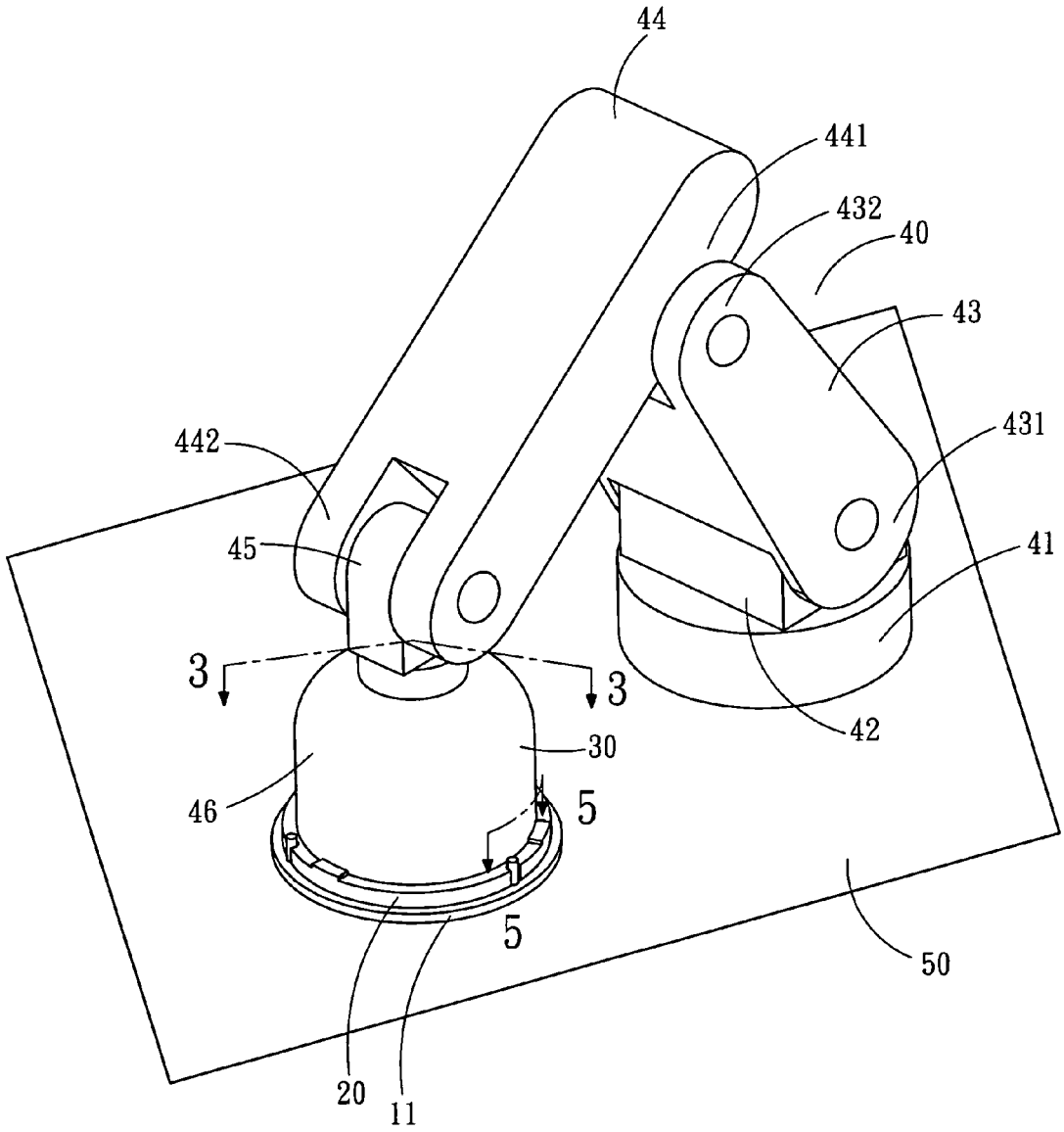
FIG. 2 is an elevational assembly view of the automatic dice shaking apparatus in accordance with the first embodiment of the present invention.
Figure 3:
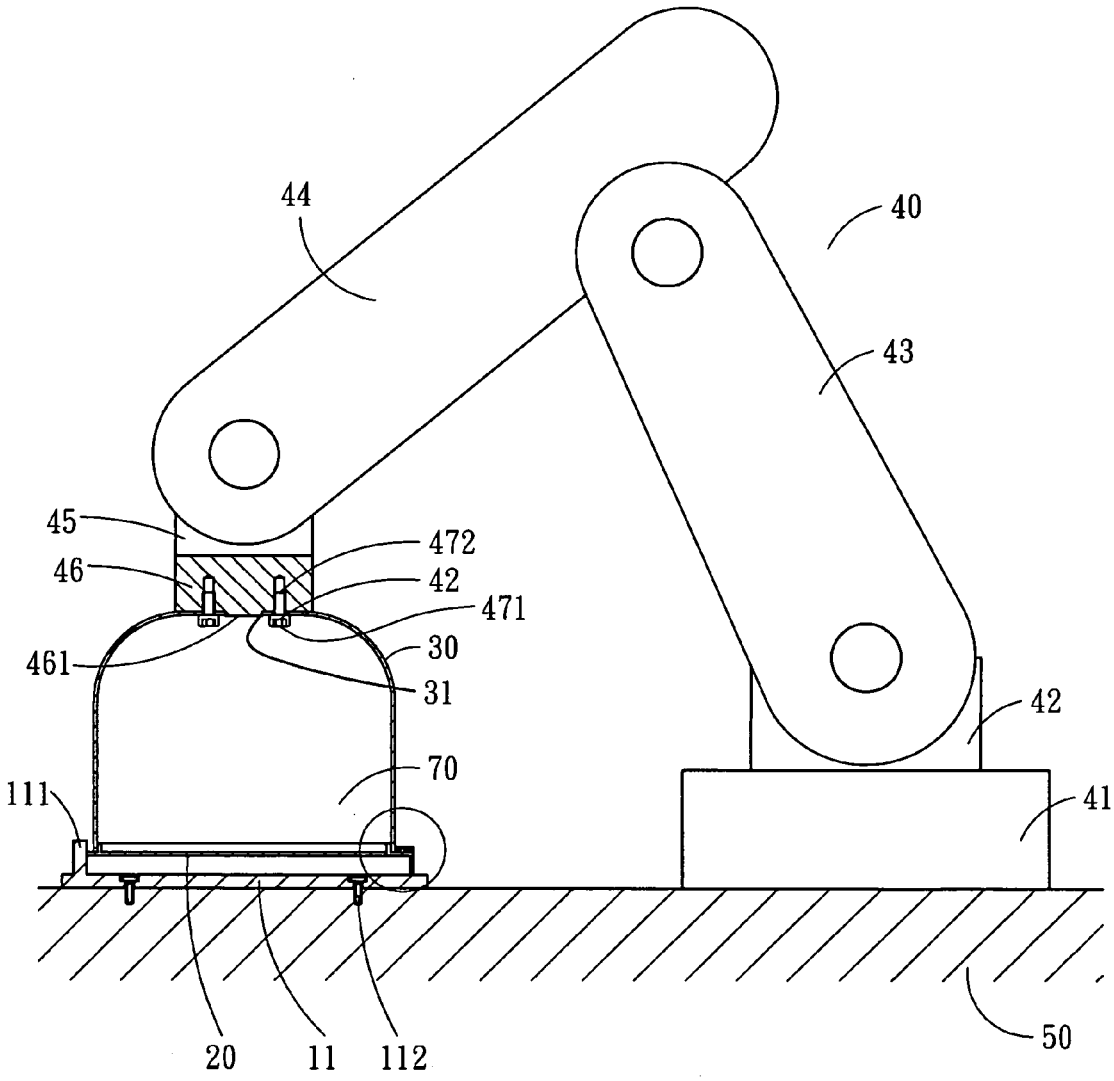
FIG. 3 is a side plain view of the automatic dice shaking apparatus in accordance with the first embodiment of the present invention, showing a sectional status of the part taken along line 3-3 of FIG. 2.
Figure 4:
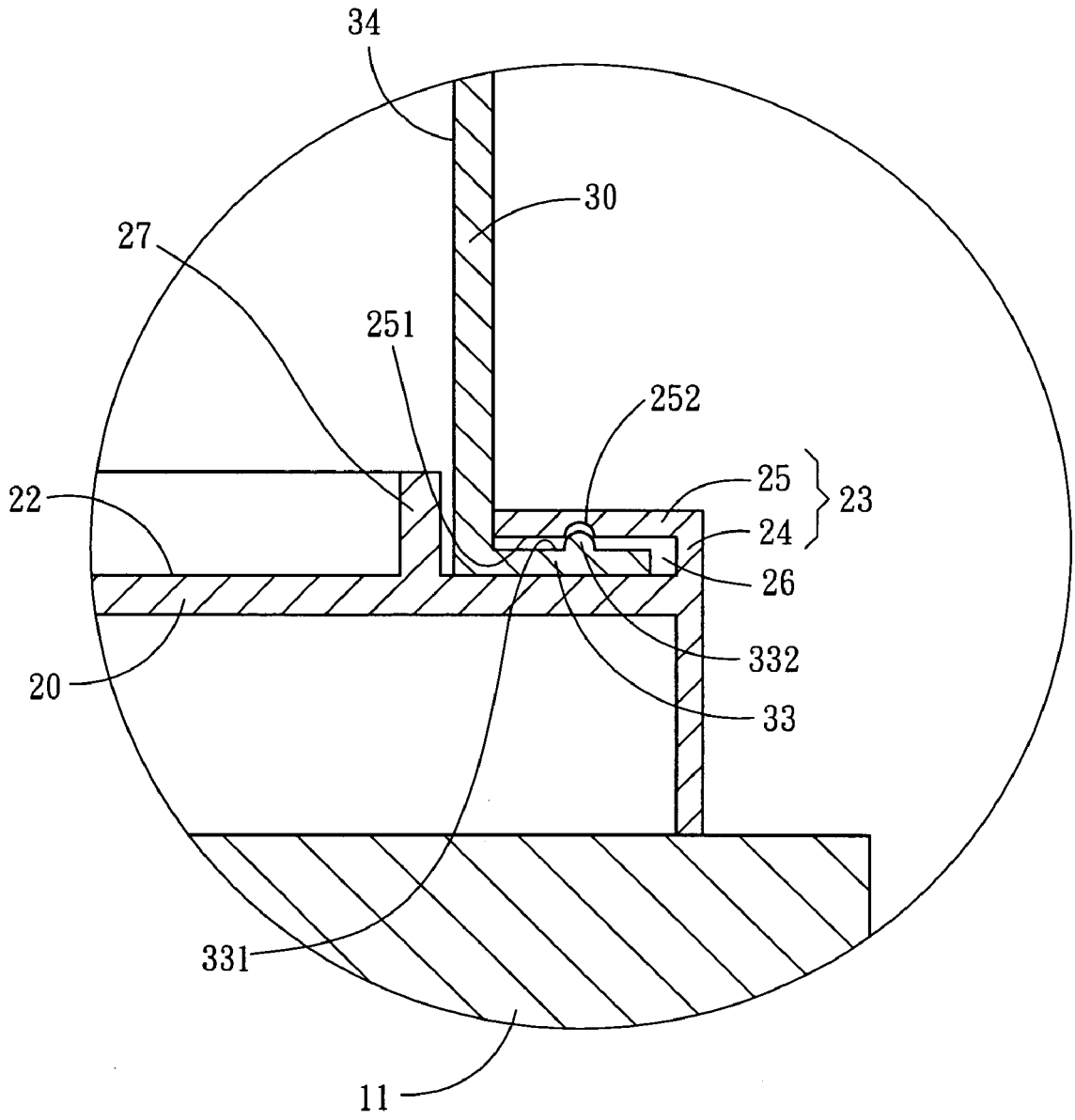
FIG. 4 is an enlarged view of a part of FIG. 3.
Figure 5:
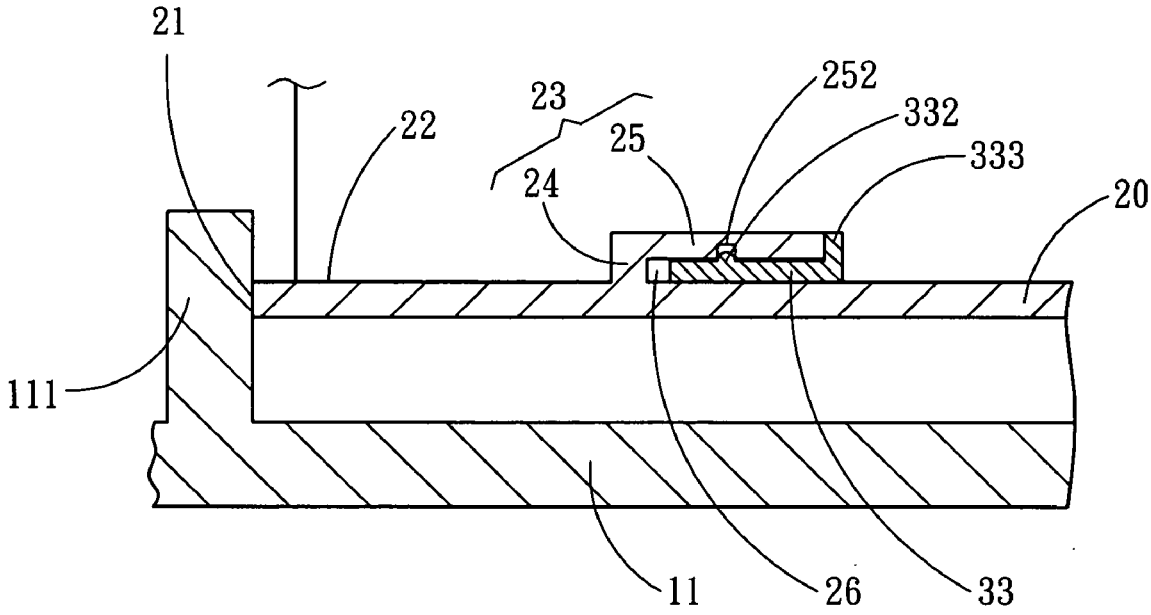
FIG. 5 is an enlarged sectional view taken along line 5-5 of FIG. 2.
Figure 6:
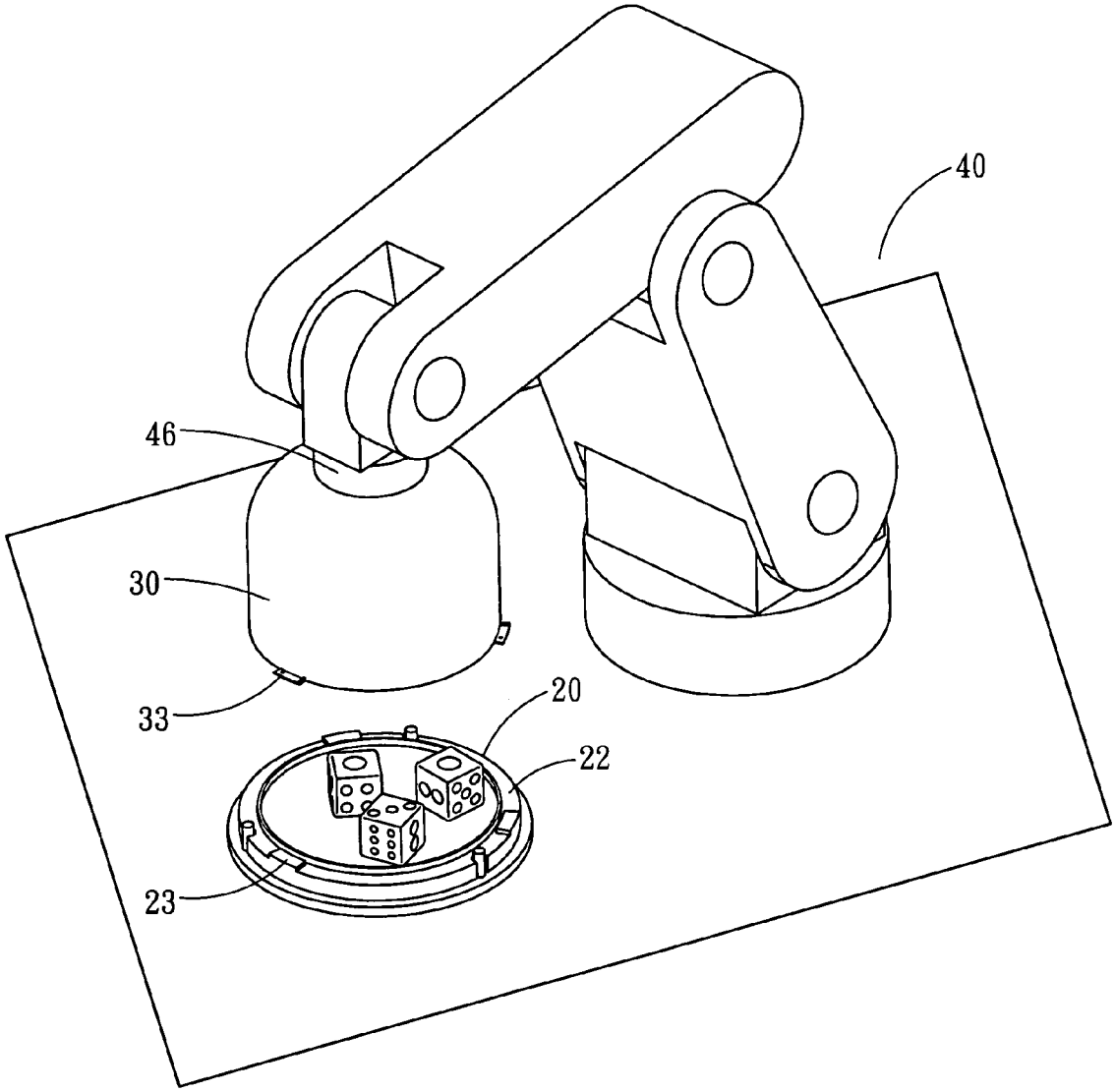
FIG. 6 is an elevational view of the first embodiment of the present invention, showing the status of the automatic dice shaking apparatus before dice shaking operation.
Figure 7:
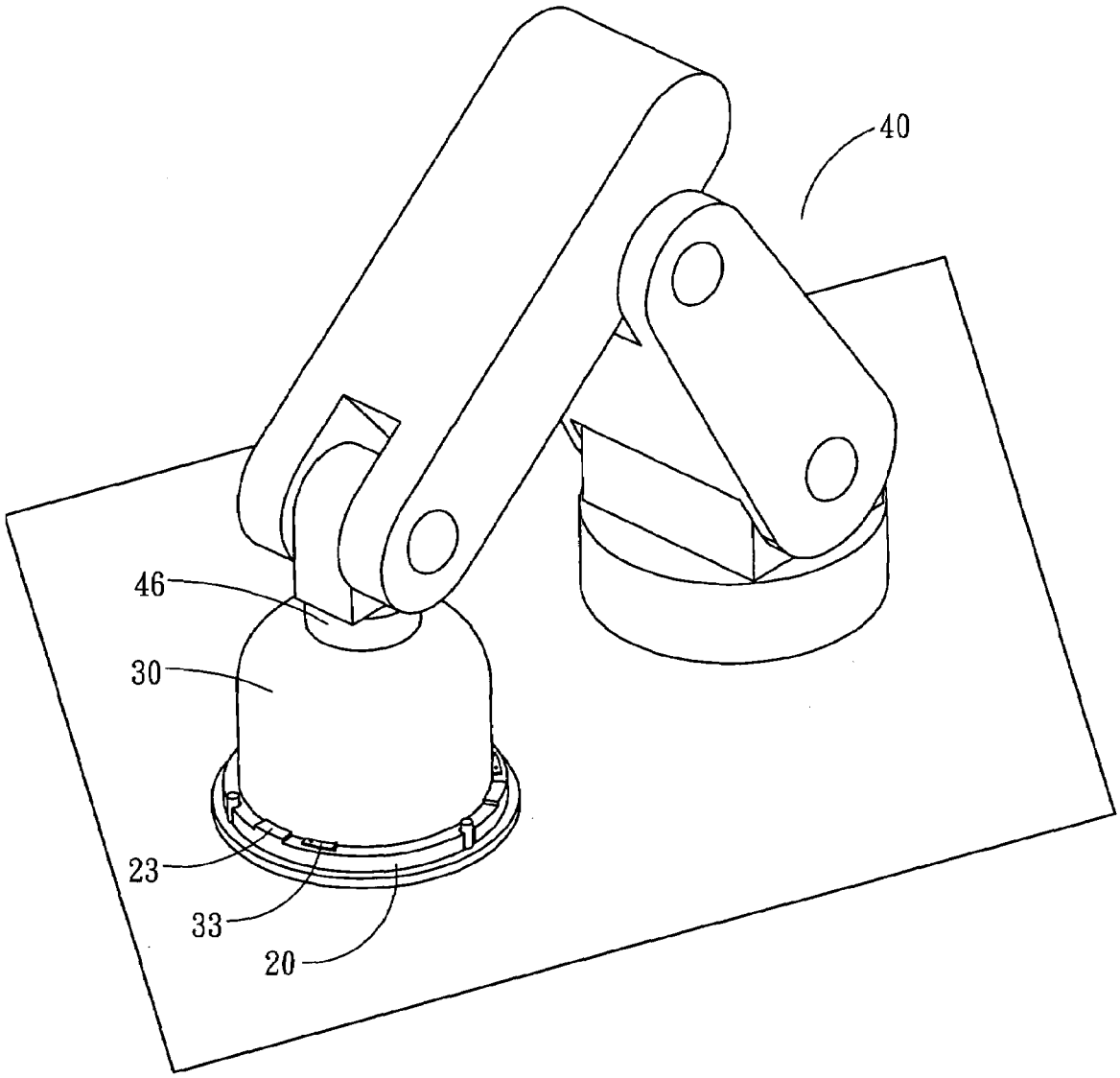
FIG. 7 is an elevational view of the first embodiment of the present invention, showing the dice cup the automatic dice shaking apparatus positioned on the dice seat at the plane.
Figure 8:
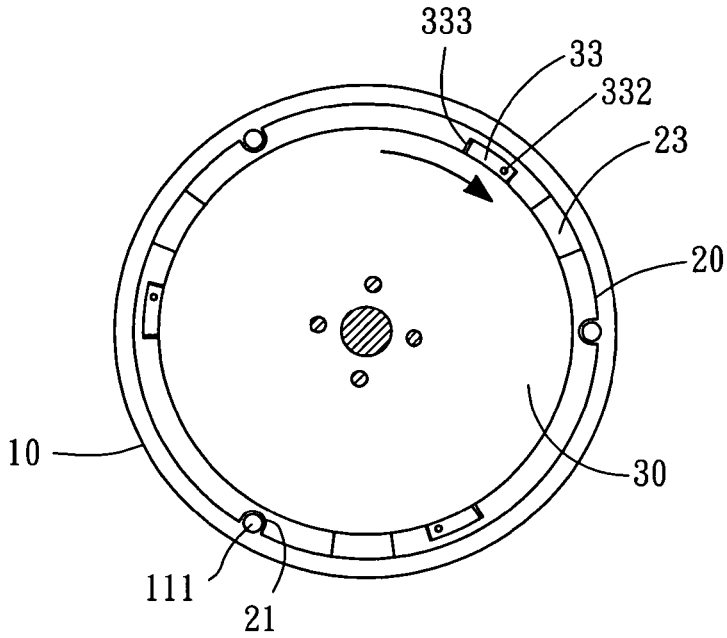
FIG. 8 is a schematic sectional top view of the first embodiment of the present invention, showing the dice cup the automatic dice shaking apparatus attached to the dice seat before engagement.
Figure 9:
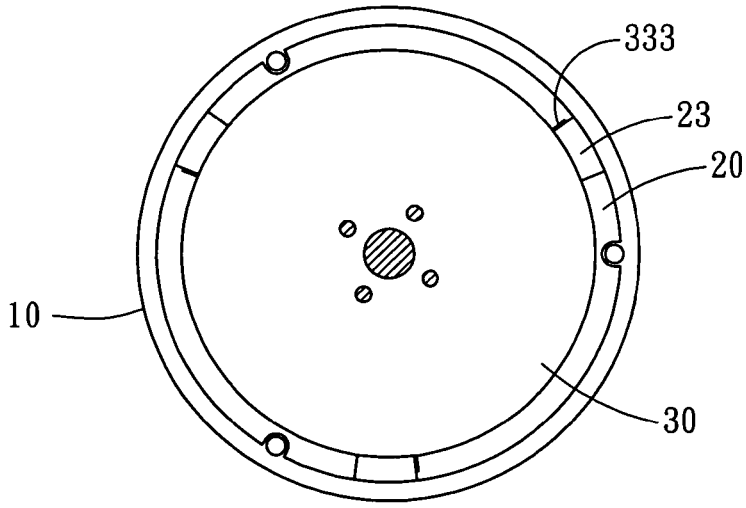
FIG. 9 corresponds to FIG. 8, showing the retaining devices of the dice cup forced into engagement with the retaining devices of the dice seat.
Figure 10:
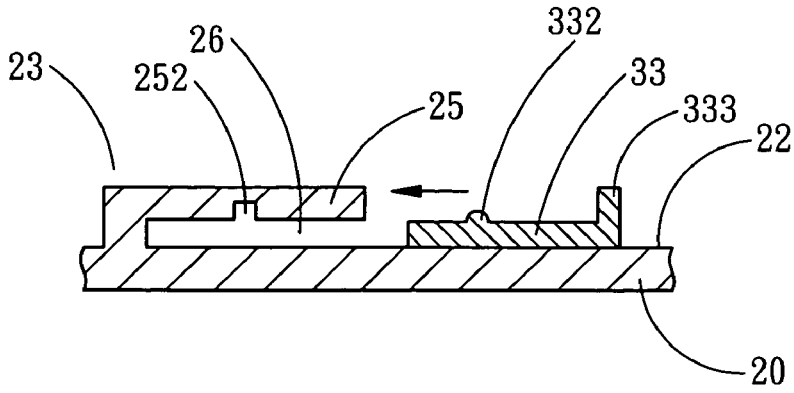
FIG. 10 is a sectional view of a part of the first embodiment of the present invention, showing the relationship between the retaining device of the dice cup and the respective retaining device of the dice seat before engagement.
Figure 11:
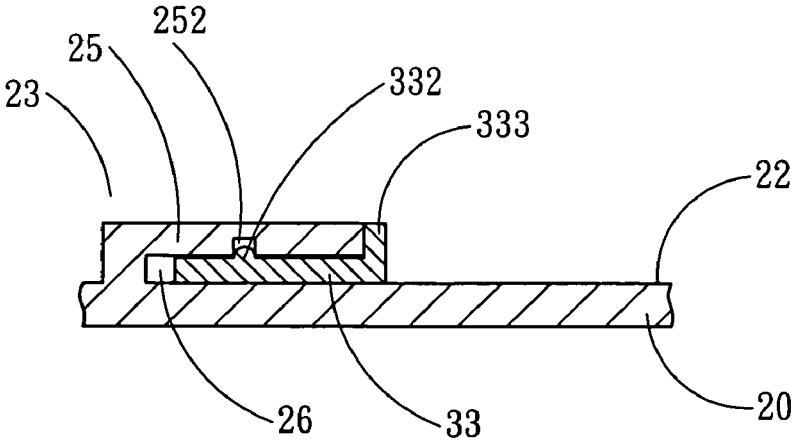
FIG. 11 corresponds to FIG. 10, showing the retaining device of the dice cup engaged with the respective retaining device of the dice seat.
Figure 12:
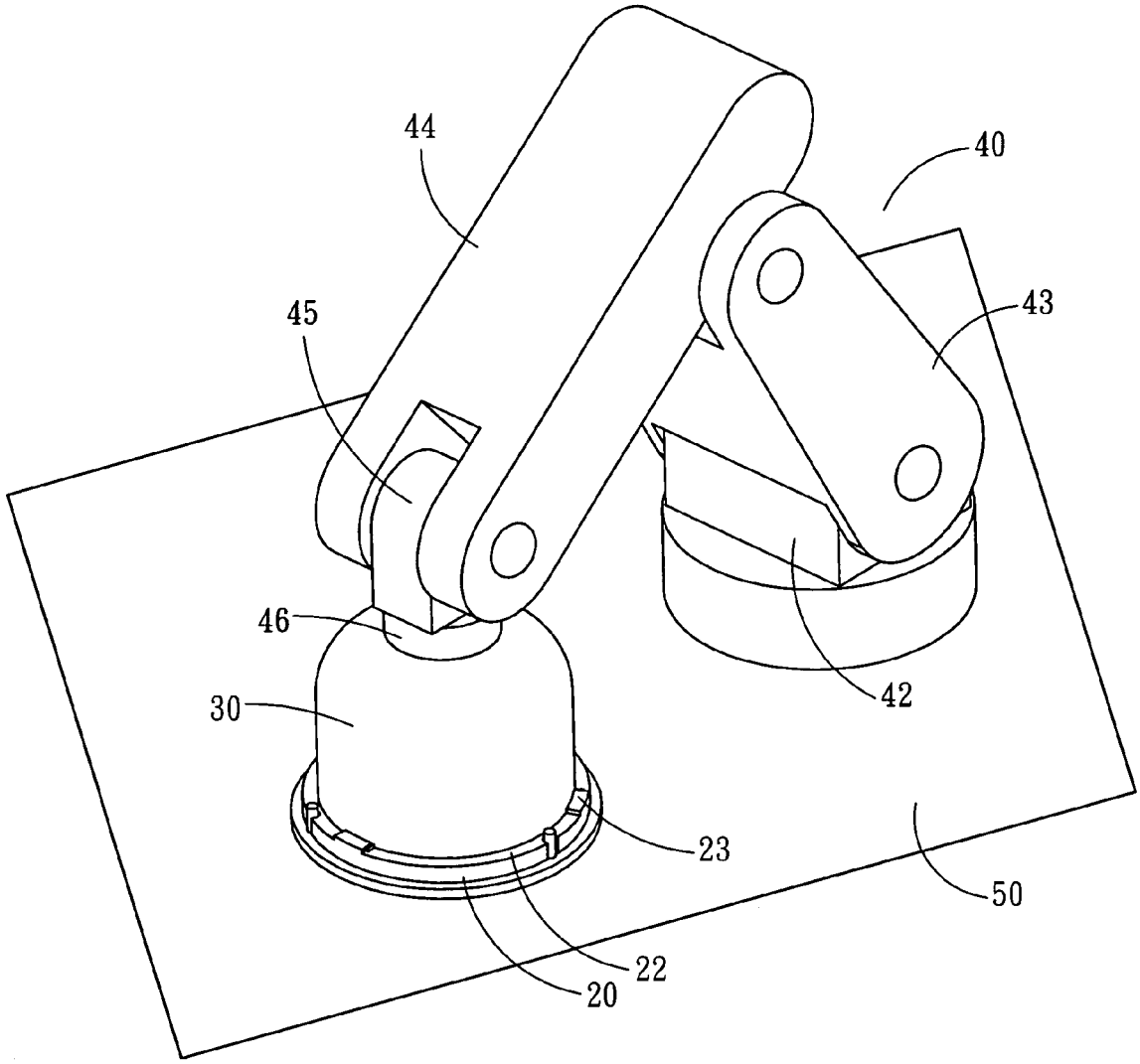
FIG. 12 is an elevational view of the first embodiment of the present invention, showing the retaining devices of the dice cup engaged with the retaining devices of the dice seat.

Referring to FIGS. 1~5, an automatic dice shaking apparatus in accordance with a first embodiment of the present invention is shown comprising: a positioning unit 10, a dice seat 20, a dice cup 30, and a mechanical arm 40.

The positioning unit 10 is fixedly located on a plane 50. According to this first embodiment, the positioning unit 10 comprises a flat circular base panel 11 affixed to the plane 50 with screws 112, and three upright posts 111 perpendicularly upwardly extending from the top surface of the flat circular base panel 11 and equiangularly spaced around the border of the flat circular base panel 11.

The dice seat 20 is adapted for carrying dice 60. The dice seat 20 is detachably connectable to the flat circular base panel 11 and movable apart from the flat circular base panel 11 in the vertical direction only. According to this first embodiment, the dice seat 20 is a circular plate member having three positioning grooves 21 equiangularly spaced around the border. The positioning grooves 21 are formed in the periphery of the dice seat 20 and respectively vertically coupled to the upright posts 111 of the positioning unit 10 to prohibit rotation of the dice seat 20 relative to the flat circular base panel 11 and to constrain movement of the dice seat 20 relative to the flat circular base panel 11 to the vertical direction. The dice seat 20 further comprises three retaining devices 23 respectively protruded from the top wall 22 near the border area and respectively spaced between each two adjacent positioning grooves 21. Each retaining devices 23 are L-shaped flanges, each comprising a vertical portion 24 perpendicularly extending from the top wall 22 of the dice seat 20 and a horizontal portion 25 perpendicularly extended from the top end of the vertical portion 24. The horizontal portion 25 has a bottom wall 251, and a groove 252 on the bottom wall 251. Further, a retaining gap 26 is defined between the horizontal portion 25 of each retaining device 23 and the top wall 22 of the dice seat 20. The dice seat 20 further comprises an annular protrusion 27 concentrically protruded from the top wall 22 and kept spaced from the retaining devices 23 and the positioning grooves 21 at a distance.

The dice cup 30 is detachably connectable to the dice seat 20. When the dice cup 30 and the dice seat 20 are connected together, they form an enclosed dice box defining therein an enclosed dice chamber 70. According to this first embodiment, the dice cup 30 comprises a locating hole 31 located on the center of the top side thereof, four through holes 32 equiangularly spaced around the locating hole 31, and three retaining devices 33 equiangularly spaced around the periphery. Each retaining device 33 has a top protrusion 332 protruded from the top wall 331 thereof, and a rear protrusion 333 at the distal end. After connection of the dice cup 30 to the dice seat 20, the inside wall 34 of the dice cup 30 faces the annular protrusion 27 of the dice seat 20, the retaining devices 33 are respectively engaged into the retaining gaps 26 of the dice seat 20, the top protrusions 332 are respectively engaged into the grooves 252 of the retaining devices 23, and the rear protrusions 333 of the retaining devices 33 are respectively stopped against the horizontal portions 25 of the retaining devices 23, prohibiting displacement of the retaining devices 33 in the respective retaining gaps 26.

The mechanical arm 40 comprises a mount 41 affixed to the plane 50, a pivot holder 42 rotatably mounted on the mount 41, a first swing arm 43, which has one end 431 pivotally connected to the pivot holder 42, a second swing arm 44, which has one end 441 pivotally connected to the other end 432 of the first swing arm 43, and a swing head 45 pivotally connected to the other end 442 of the second swing arm 44, and a rotation head 46 connected to the swing head 45 and rotatable relative to the wing head 45. The rotation head 46 comprises a locating protrusion 461 inserted into the locating hole 31 of the dice cup 30. Further, four screws 47 are respectively upwardly inserted through the through holes 32 and driven into the rotation head 46 to affix the dice cup 30 to the rotation head 46. Each screw 47 comprises a head 471 that has an outer diameter greater than the through holes 32, and a threaded shank 472 that has an outer diameter smaller than the through holes 32. After the screws 47 have been inserted through the through holes 32 and driven into the rotation head 46, the heads 471 of the screws 47 are respectively stopped at the inside wall 34 of the dice cup 30 against the rotation head 46, securing the dice cup 30 to the rotation head 46 firmly.

By means of the aforesaid composition, the mechanical arm 40 is operable to connect the dice cup 30 and the dice seat 20 together, and then to separate the dice seat 20 with the dice cup 30 from the positioning unit 10, and then to shake the dice seat 20 and the dice cup 30, and then to couple the dice seat 20 to the positioning unit 10, and then to separate the dice cup 30 from the dice seat 20.

After understanding of the structure and configuration of the component parts of the automatic dice shaking apparatus of the first embodiment of the present invention, the operation of the automatic dice shaking apparatus is described hereinafter:

1. With respect to the operation of the mechanical arm 40 in connecting the dice cup 30 and the dice seat 20 together, please refer to FIGS. 6~12. The mechanical arm 40 is controlled to carry the dice cup 30 downwards to the position where the dice cup 30 touches the top wall 22 of the dice seat 20 and the retaining devices 33 are respectively disposed corresponding to the retaining devices 23. Thereafter, the mechanical arm 40 is controlled to rotate the rotation head 46 in a clockwise direction, causing the dice cup 30 to be synchronously rotated with the rotation head 46 to force the retaining devices 33 into the retaining gaps 26 of the dice seat 20 respectively. At this time, the top protrusions 332 are respectively engaged into the grooves 252 of the horizontal portion 25 of the retaining devices 23, and the rear protrusions 333 of the retaining devices 33 are respectively stopped against the horizontal portions 25 of the retaining devices 23, preventing displacement of the retaining devices 33 in the respective retaining gaps 26, and therefore the dice cup 30 and the dice seat 20 are firmly secured together for movement by the mechanical arm 40.

Figure 13:
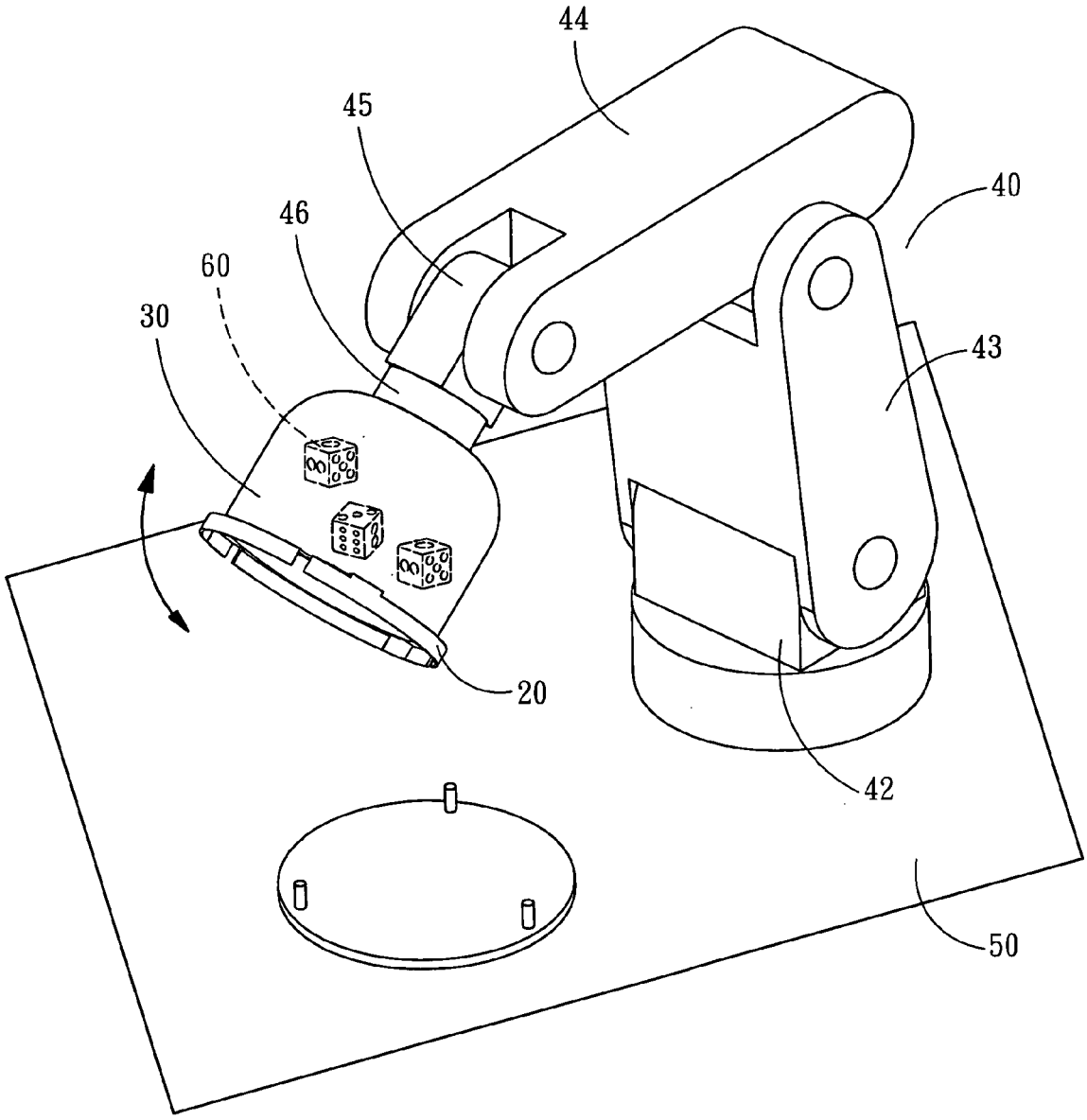
FIG. 13 is a schematic drawing of the first embodiment of the present invention, showing the dice shaking operation of the automatic dice shaking apparatus.

2. With respect to the operation of the mechanical arm 40 in disconnecting the dice cup 30 and the dice seat 20 from the positioning unit 10 and shaking the dice, please refer to FIGS. 12 and 13. After connection between the dice cup 30 and the dice seat 20, the mechanical arm 40 is controlled to carry the dice cup 30 and the dice seat 20 vertically upwards to a certain distance such that shaking the dice does not strike the plane 50 and the positioning unit 20. The dice shaking operation to shake the dice 60 in the enclosed dice chamber 70 is achieved by means of relative motion among the pivot holder 42, the first swing arm 43, the second swing arm 44, the rotation head 46 and the swing head 45.

Figure 14:
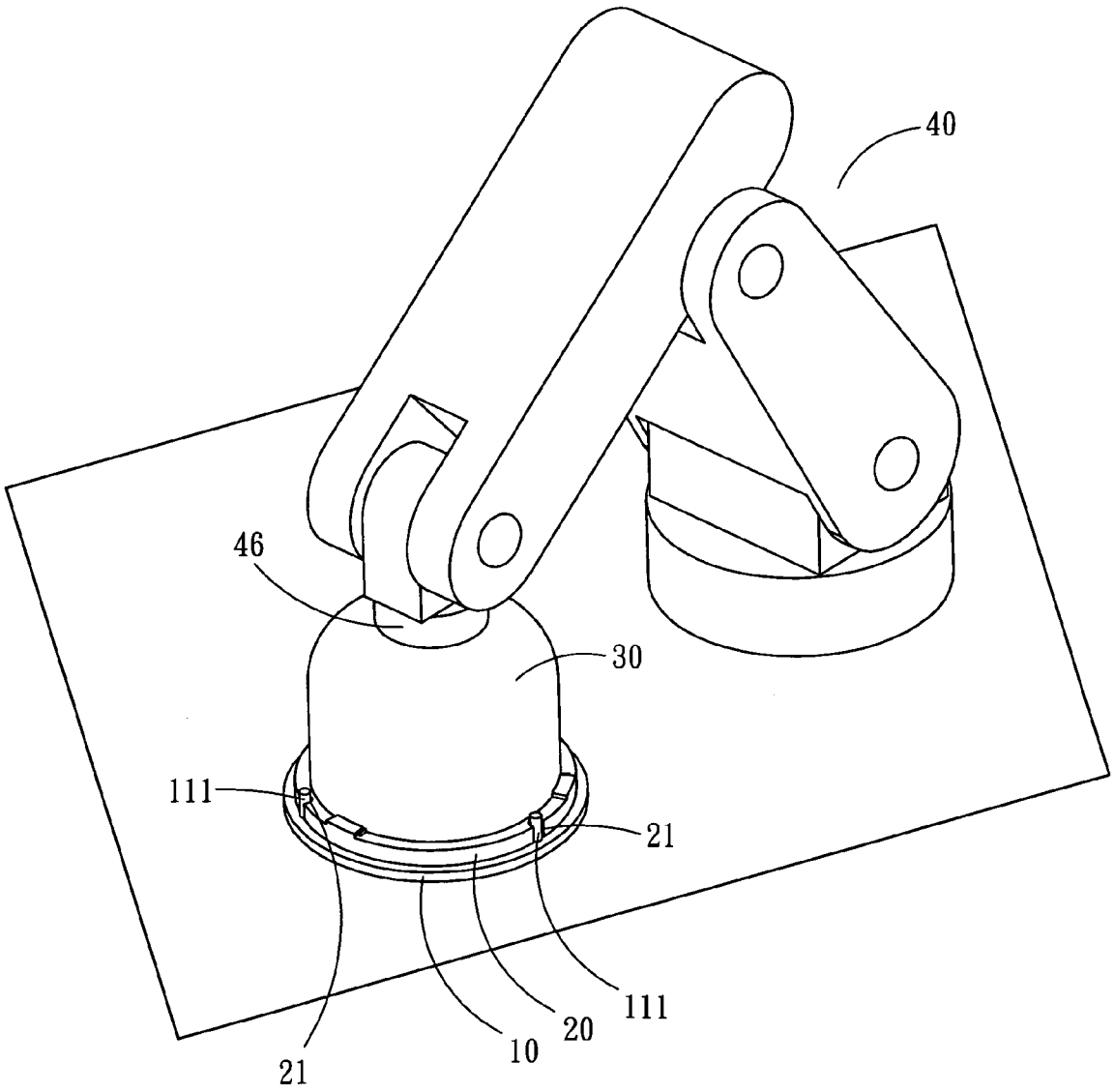
FIG. 14 is an elevational view of the first embodiment of the present invention, showing the dice cup and the dice seat attached to the positioning unit at the plane after the dice shaking operation.
Figure 15:
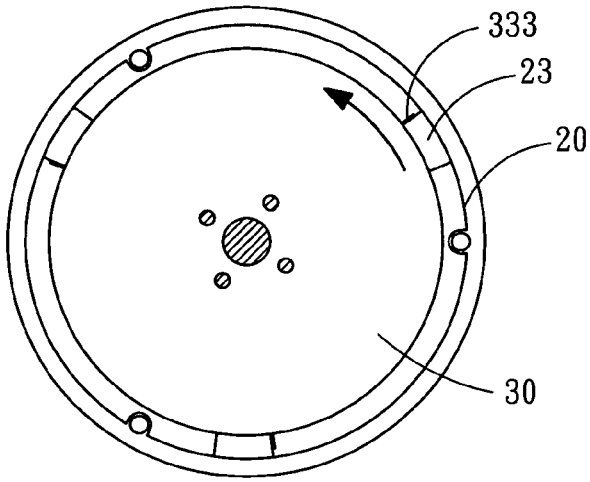
FIG. 15 is a schematic top plain view of a part of the first embodiment of the present invention, showing the status of the dice cup and the dice seat before disengagement between the retaining devices of the dice cup and the retaining devices of the dice seat.
Figure 16:
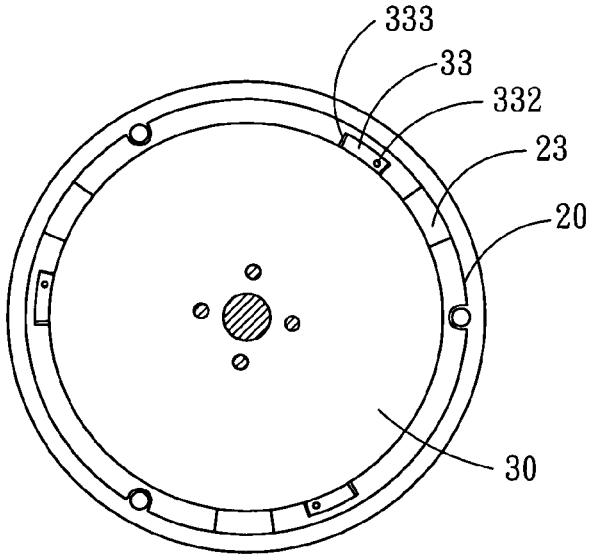
FIG. 16 corresponds to FIG. 15, showing the retaining devices of the dice cup disengaged from the retaining devices of the dice seat.
Figure 17:
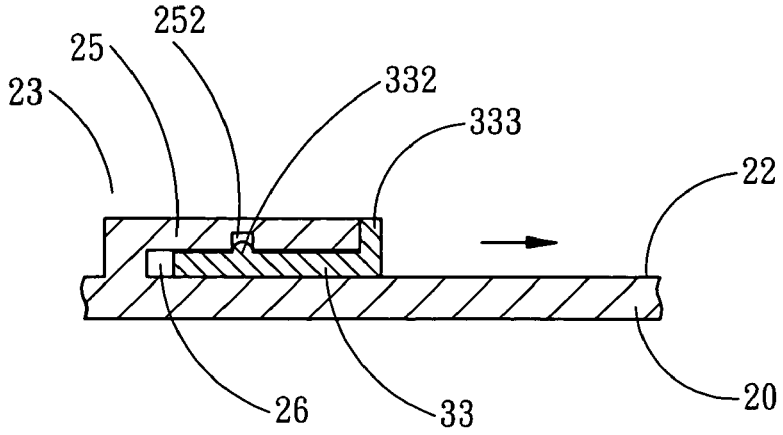
FIG. 17 is a schematic sectional view of a part of the first embodiment of the present invention, showing the status of the dice cup and the dice seat before disengagement between one retaining device of the dice cup and the associating retaining device of the dice seat.
Figure 18:
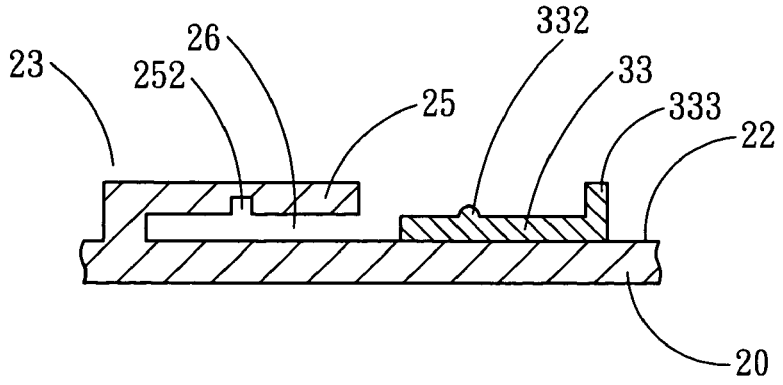
FIG. 18 corresponds to FIG. 17, showing the retaining device of the dice cup disengaged from the associating retaining device of the dice seat.
Figure 19:
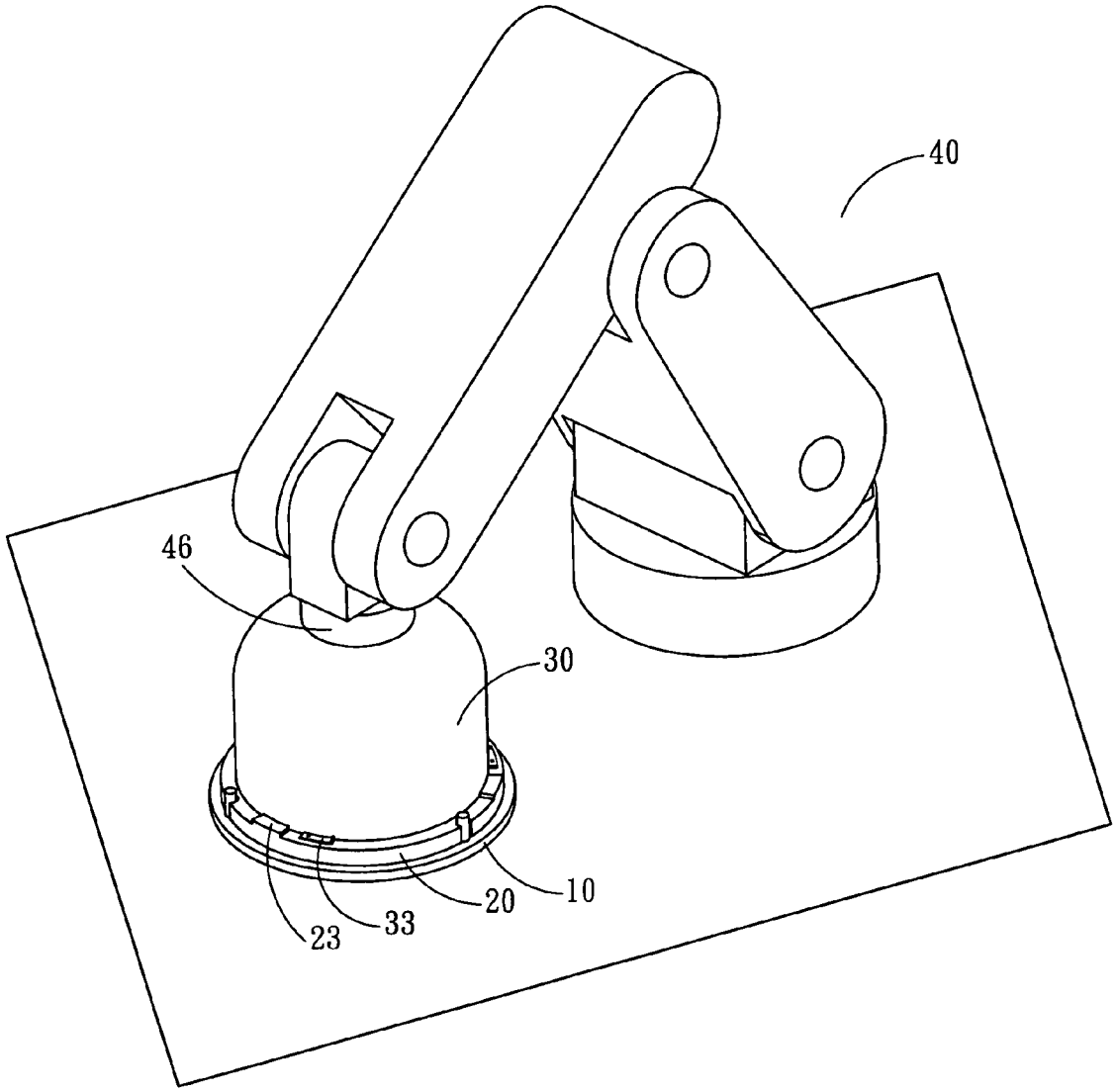
FIG. 19 is an elevational view of the first embodiment of the present invention, showing the retaining devices of the dice cup disengaged from the retaining devices of the dice seat before separation of the dice cup from the dice seat.
Figure 20:
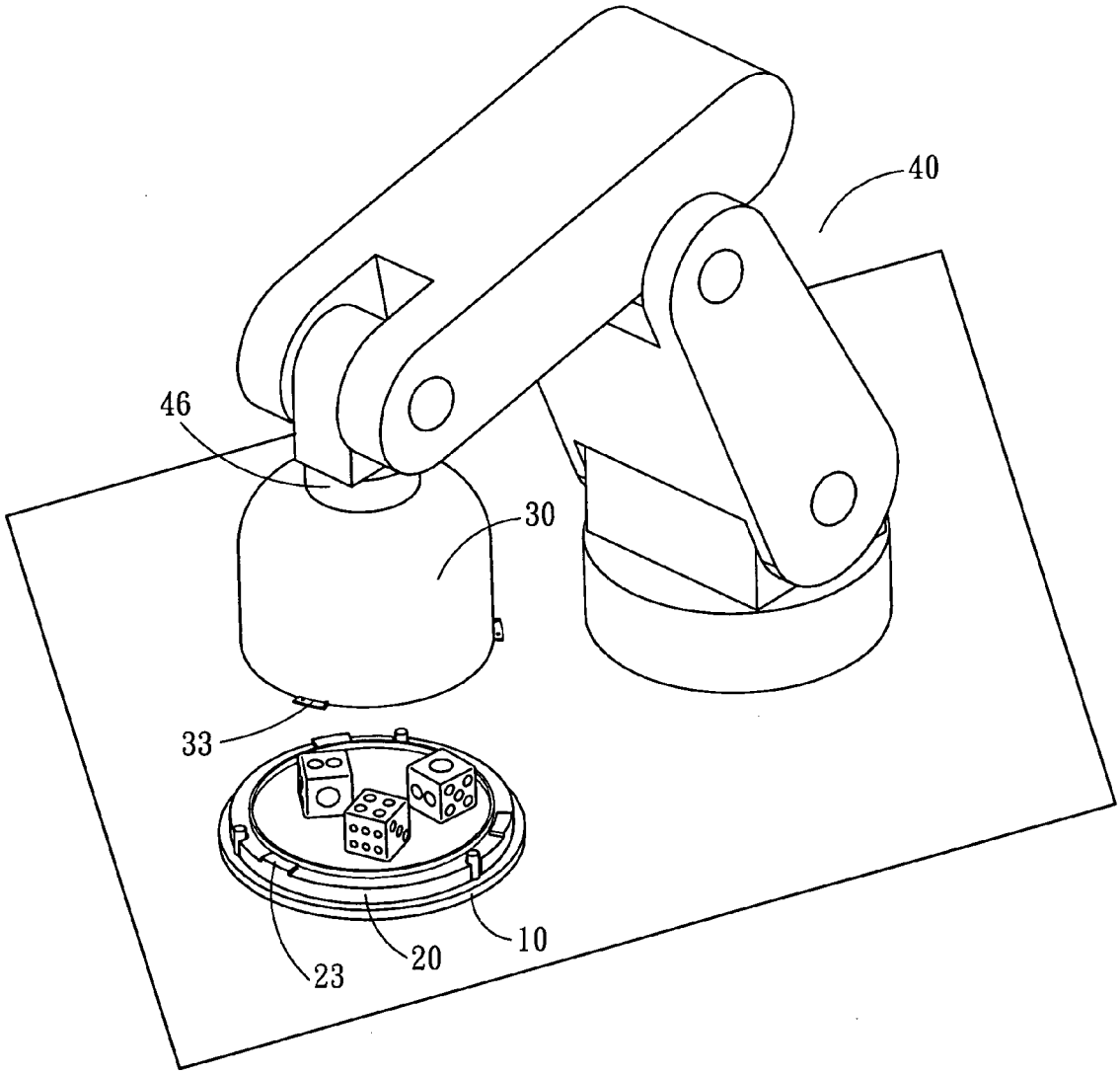
FIG. 20 corresponds to FIG. 19, showing the dice cup opened from the dice seat.

3. With respect to the positioning of the dice cup 30 and the dice seat 20 after the dice 60 have been shaken, please refer to FIG. 14. After the dice 60 have been shaken, the mechanical arm 40 is controlled to carry the dice cup 30 and the dice seat 20 to the position where the positioning grooves 21 of the dice seat 20 are respectively coupled to the upright posts 111 of the positioning unit 10, keeping the dice seat 20 secured to the positioning unit 20, and thus the positioning of the dice cup 30 and the dice seat 20 is done.

4. With respect to the operation of disconnecting the dice cup 30 from the dice seat 20 after positioning of the dice seat 20 on the positioning unit 10, please refer to FIGS. 14~20. After the dice seat 20 has been connected to the positioning unit 10, the mechanical arm 40 is controlled to rotate the rotation head 46 in a counter-clockwise direction, causing the dice cup 30 to be rotated with the rotation head 46 to disengage the retaining devices 33 of the dice cup 30 from the retaining gaps 26 of the retaining devices 23 respectively, and at the same time, the top protrusions 332 of the retaining devices 33 are respectively disengaged from the grooves 252 of the horizontal portions 25 of the retaining devices 23, and therefore the dice cup 30 is disengaged from the dice seat 20. Thereafter, the mechanical arm 40 is controlled to lift the dice cup 30 from the dice seat 20, and therefore the dice cup opening operation is done.

Thus, subject to the structural design of the aforesaid automatic dice shaking apparatus, the invention achieves the following effects:

1. Because the automatic dice shaking apparatus enables all the game procedures (such as dice shaking, dice cup opening, and etc.) to be done through a computer-controlled mechanical arm without any labor, the invention prevents a dealer from controlling the points of the dice by means of a manipulation skill and avoids presence of the points expected by the banker by means of the control of the muscular strength of the hand shaking the dice. Therefore, the invention effectively eliminates cheating and improves game fairness.

2. Because all actions (such as dice shaking, dice cup opening, and etc.) during the dice game are done through a computer-controlled mechanical arm without any labor, it is not necessary to hire a person for the actions of shaking the dice and opening the dice cup. Therefore, the invention helps reduce the dice game personnel cost.

Figure 21:
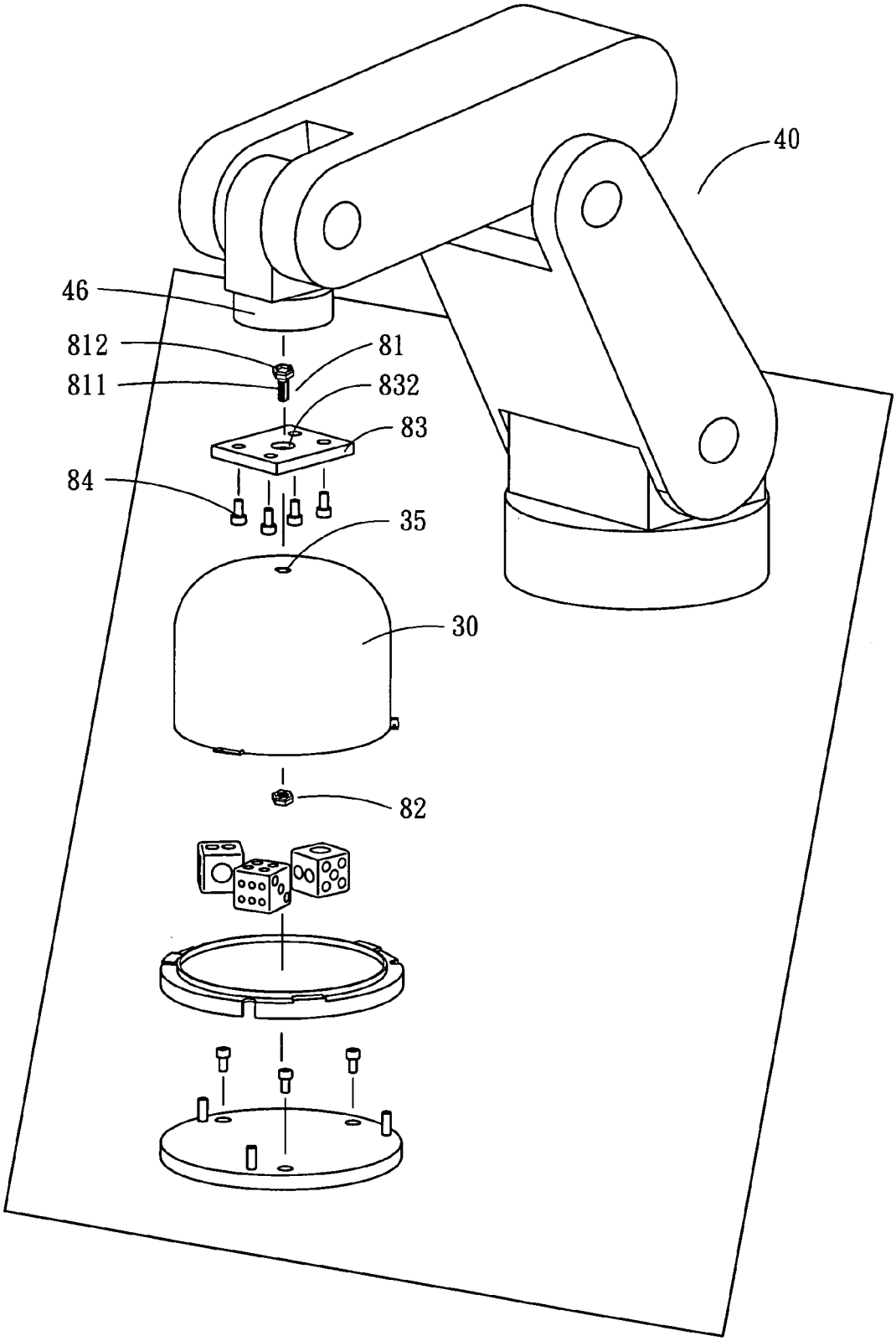
FIG. 21 is an exploded view of an automatic dice shaking apparatus in accordance with a second embodiment of the present invention
Figure 22:
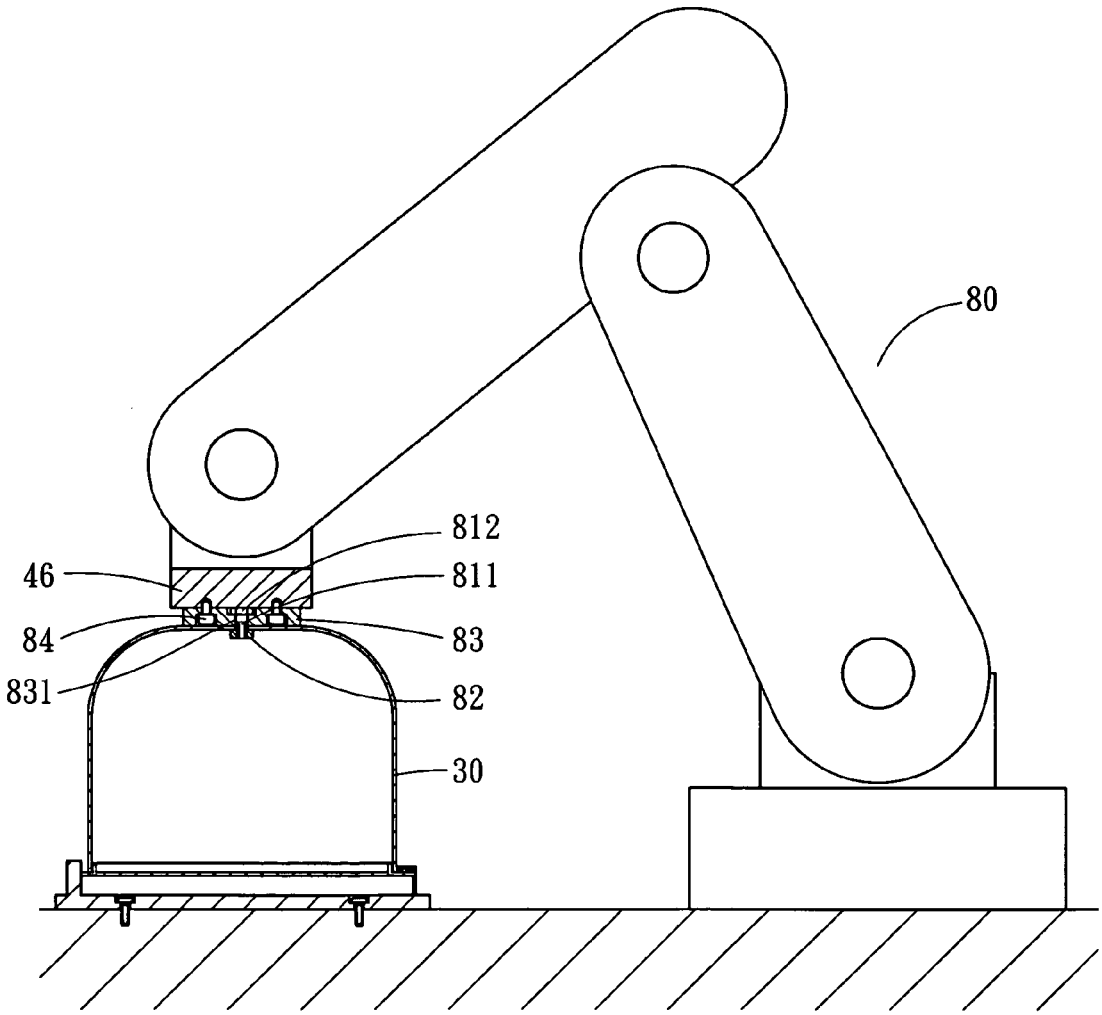
FIG. 22 is a side plain view, partially in section of the automatic dice shaking apparatus in accordance with the second embodiment of the present invention
Figure 23:
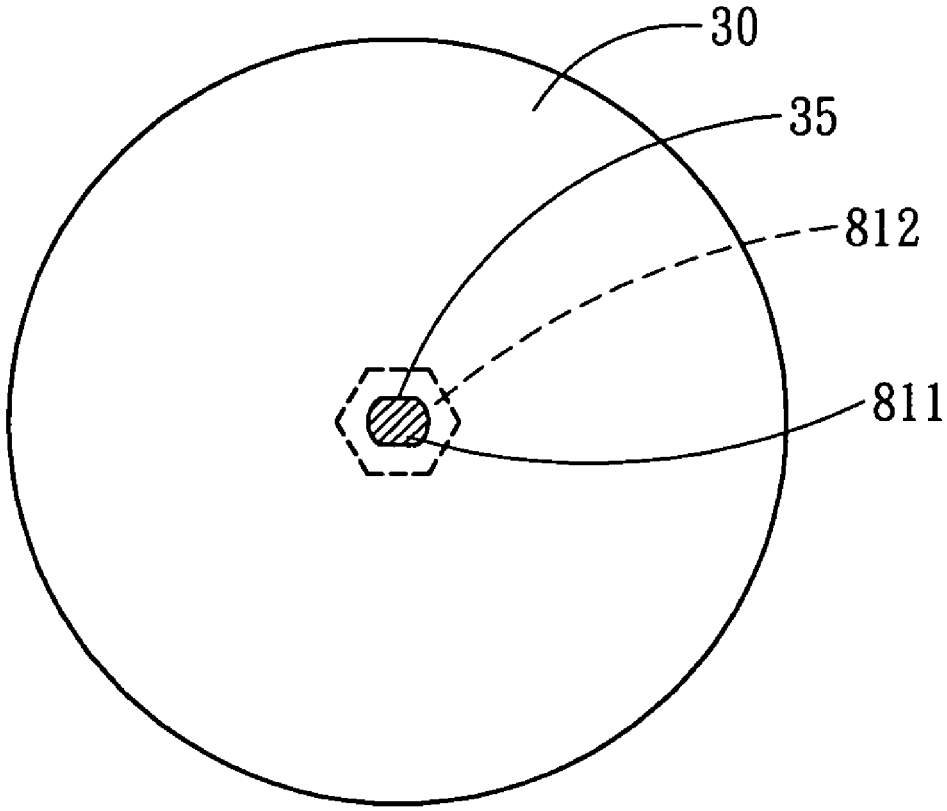
FIG. 23 is a schematic top plain view of a part of the second embodiment of the present invention, showing the connection status between the first connection device and the connection hole of the dice cup.

FIGS. 21~23 show an automatic dice shaking apparatus in accordance with a second embodiment of the present invention: The configuration and effects of this second embodiment are substantially similar to the aforesaid first embodiment with the exception stated hereinafter. The rotation head 46 of the mechanical arm 40 according to this second embodiment matches with a first connection device 81. The first connection device 81 comprises a connection portion 811 that has a non-circular cross section, and a hexagonal head 812 that has a diameter greater than the connection portion 811. The connection device 81 is matched with a locating member 83. The locating member 83 is affixed to the rotation head 46 by four screws 84, having a center through hole 831 and a center countersunk hole 832 coincided with the center through hole 831. The center countersunk hole 832 has a diameter greater than the center through hole 831. Further, the dice cup 30 has a connection hole 35 at the top. During installation, the connection portion 811 of the connection device 81 is inserted through the center through hole 831 of the locating member 83 and the connection hole 35 of the dice cup 30 and then fastened up with a fastening element 82, and the hexagonal head 812 is fitted into the center countersunk hole 832, and therefore the dice cup 30 is fastened to the rotation head 46. During rotation of the rotation head 46, the first connection device 81 and the dice cup 30 are synchronously rotated with the rotation head 46.

Figure 24:
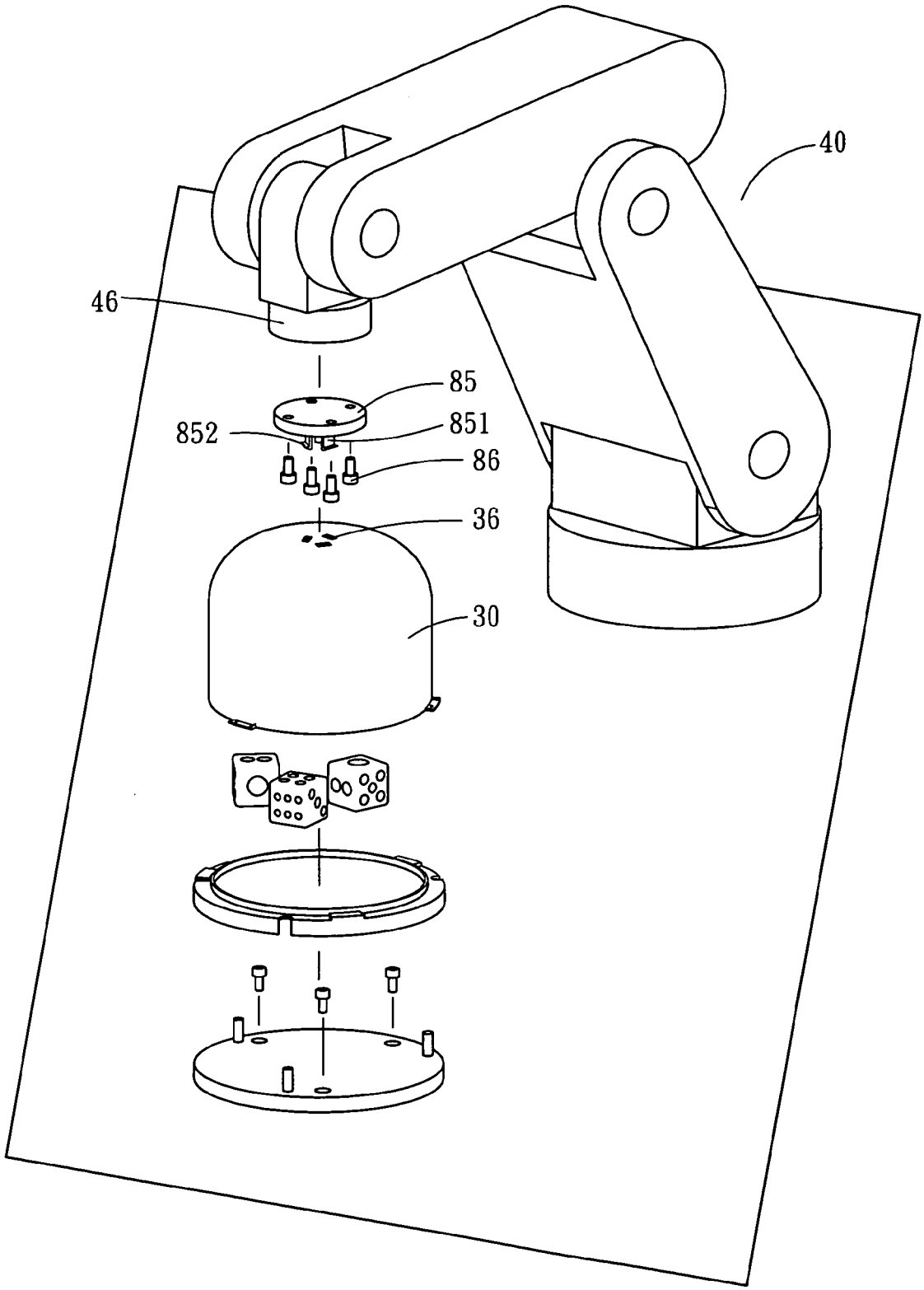
FIG. 24 is an exploded view of an automatic dice shaking apparatus in accordance with a third embodiment of the present invention
Figure 25:
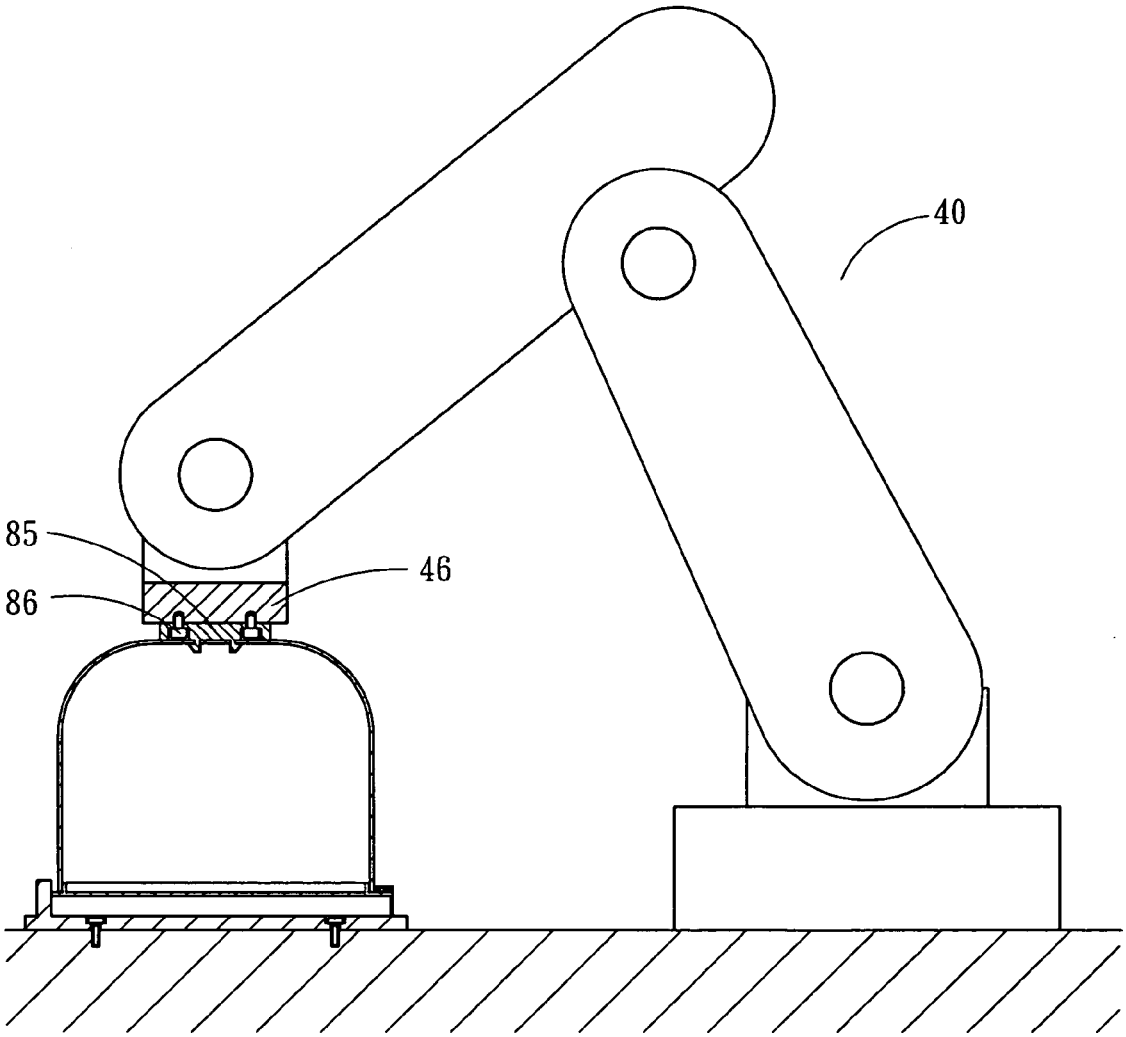
FIG. 25 is a side plain view, partially in section of the automatic dice shaking apparatus in accordance with the third embodiment of the present invention

FIGS. 24 and 25 show an automatic dice shaking apparatus in accordance with a third embodiment of the present invention: The configuration and effects of this third embodiment are substantially similar to the aforesaid first embodiment with the exception that the rotation head 46 of the mechanical arm 40 according to this third embodiment matches with a second connection device 85. The second connection device 85 is affixed to the rotation head 46 by four screws 86. The second connection device 85 comprises three retaining hooks 851 equiangularly and downwardly extending from the bottom side and respectively terminating in an outwardly protruding hook portion 852. Further, the dice cup 30 according to this third embodiment has three retaining holes 36 disposed at the top corresponding to the retaining hooks 851. During installation, the retaining hooks 851 are respectively hooked in the retaining holes 36, thereby securing the dice cup 30 to the rotation head 46.

Figure 26:
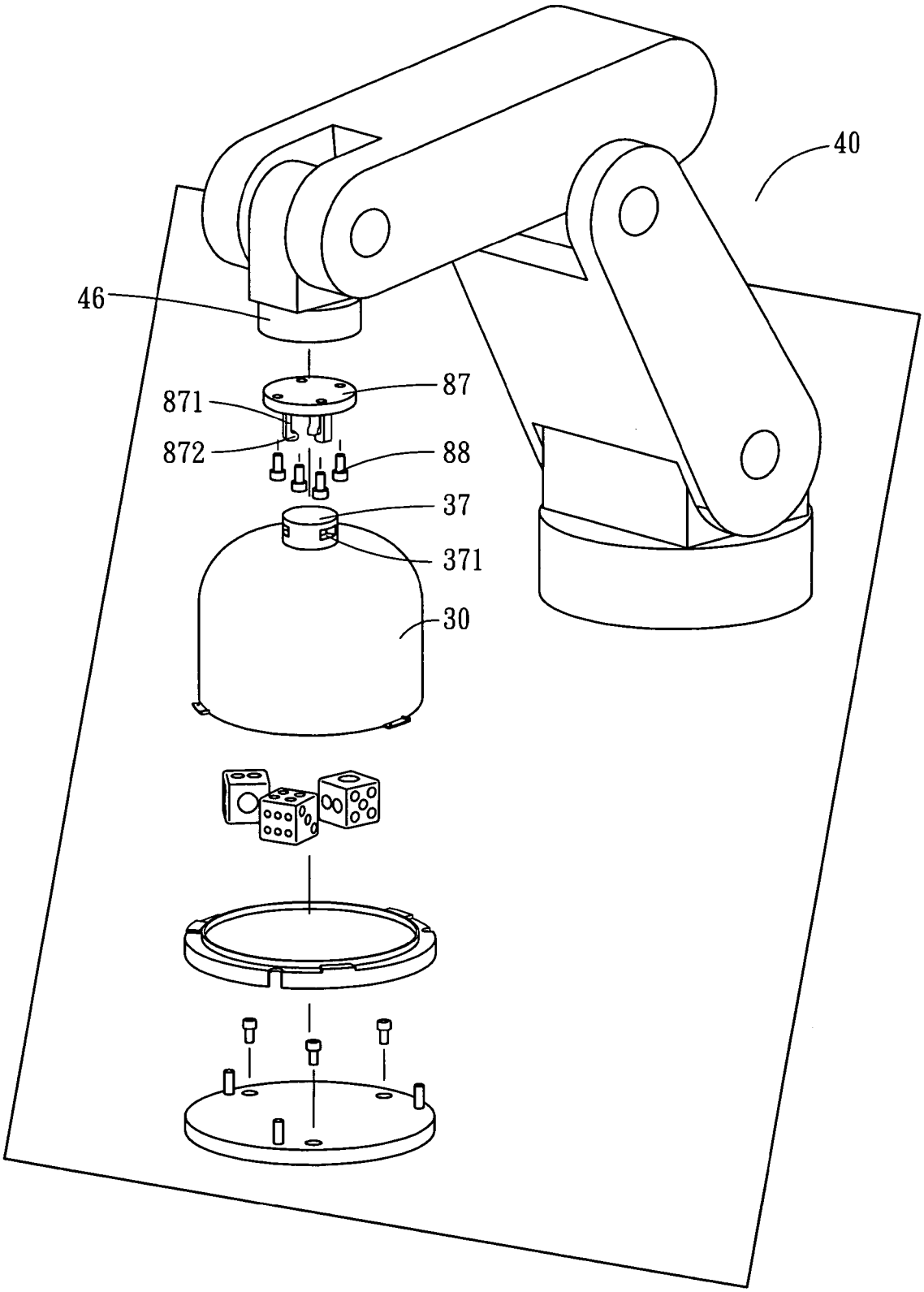
FIG. 26 is an exploded view of an automatic dice shaking apparatus in accordance with a fourth embodiment of the present invention
Figure 27:
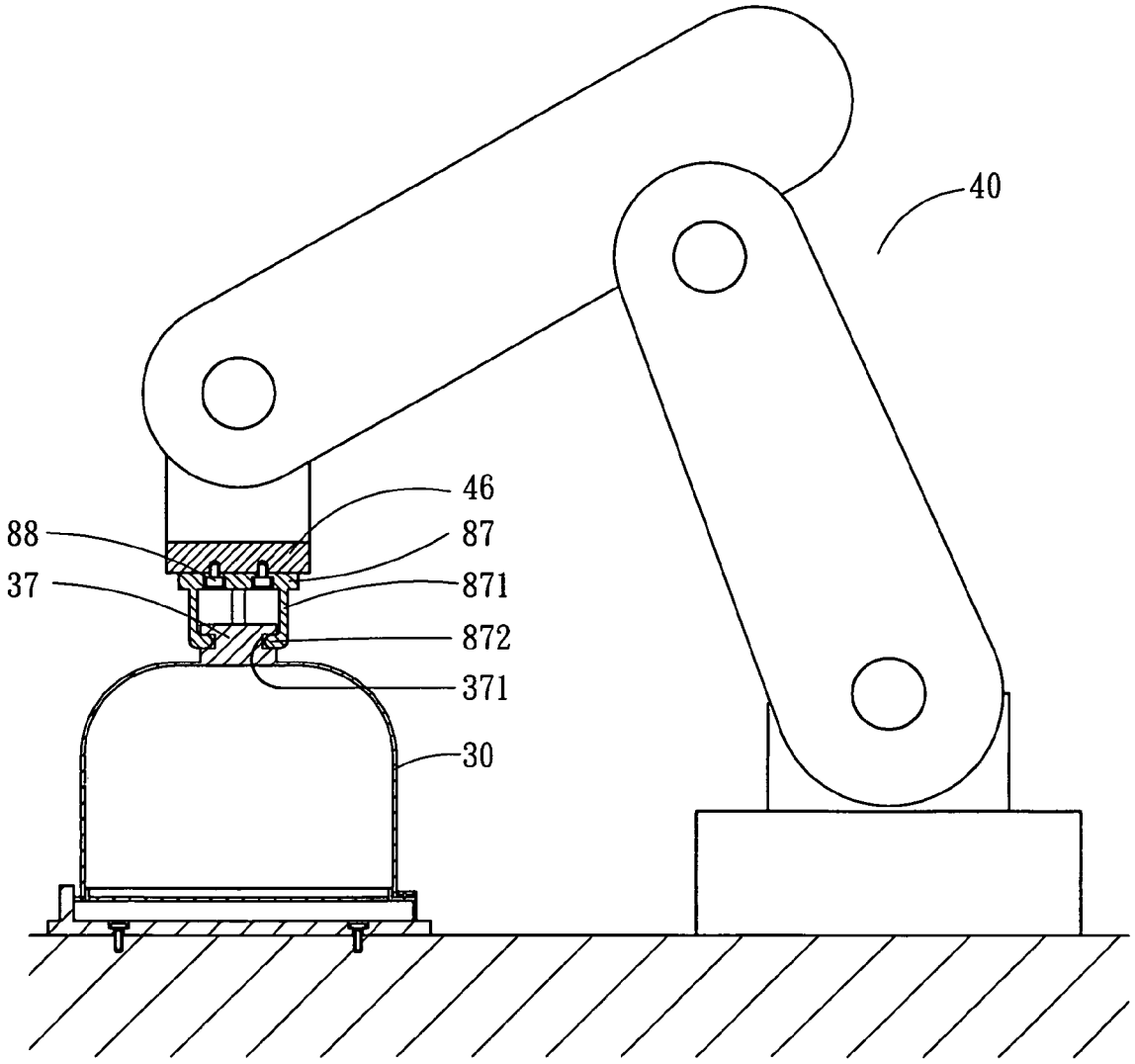
FIG. 27 is a side plain view, partially in section of the automatic dice shaking apparatus in accordance with the fourth embodiment of the present invention

FIGS. 26 and 27 show an automatic dice shaking apparatus in accordance with a fourth embodiment of the present invention: The configuration and effects of this fourth embodiment are substantially similar to the aforesaid first embodiment with the exception that the rotation head 46 of the mechanical arm 40 according to this fourth embodiment matches with a third connection device 87. The third connection device 87 is affixed to the rotation head 46 by four screws 88. The third connection device 87 comprises three retaining hooks 871 equiangularly and downwardly extending from the bottom side and respectively terminating in a respective inwardly protruding hook portion 872. Further, the dice cup 30 according to this fourth embodiment comprises a top stub shank 37 and three retaining holes 371 equiangularly spaced around the top stub shank 37. During installation, the inwardly protruding hook portions 872 of the retaining hooks 871 are respectively hooked in the retaining holes 371, thereby securing the dice cup 30 to the rotation head 46.

Figure 28:
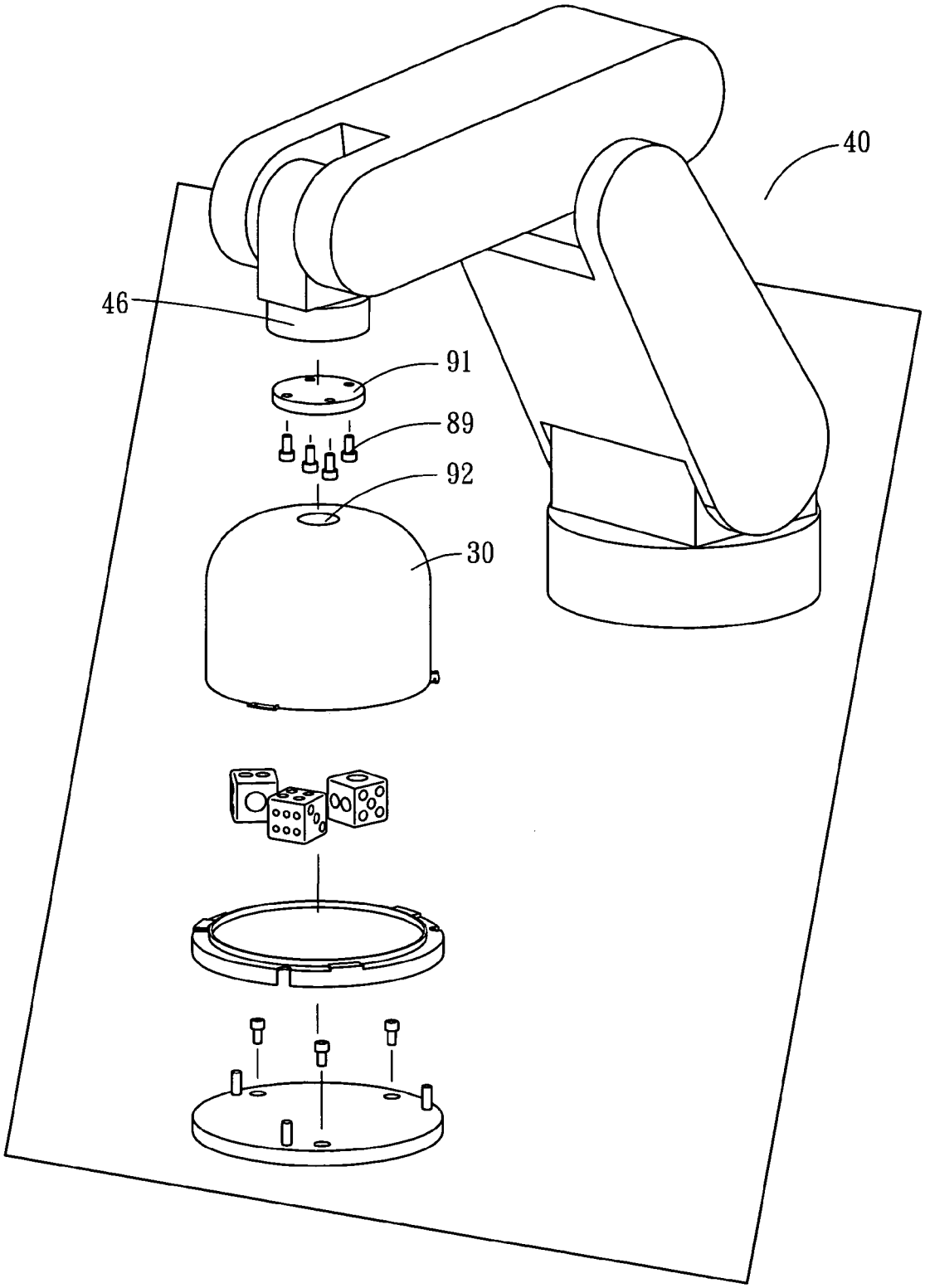
FIG. 28 is an exploded view of an automatic dice shaking apparatus in accordance with a fifth embodiment of the present invention
Figure 29:
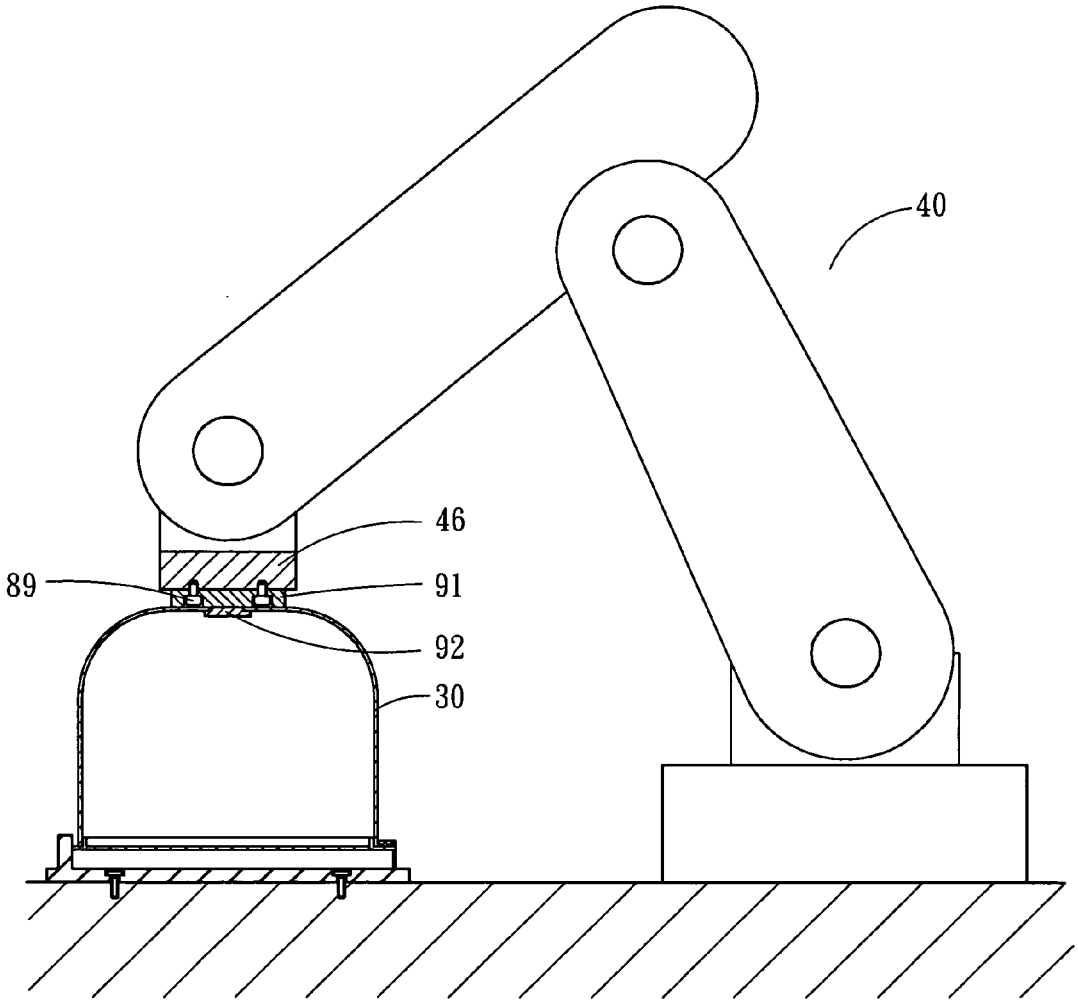
FIG. 29 is a side plain view, partially in section of the automatic dice shaking apparatus in accordance with the fifth embodiment of the present invention

FIGS. 28 and 29 show an automatic dice shaking apparatus in accordance with a fifth embodiment of the present invention: The configuration and effects of this fifth embodiment are substantially similar to the aforesaid first embodiment with the exception that the rotation head 46 of the mechanical arm 40 according to this fifth embodiment has a first magnetic member 91 fixedly fastened to the bottom side thereof by four screws 89, and the dice cup 30 has a second magnetic member 92 embedded in the top thereof. By means of magnetic attraction between the first magnetic member 91 and the second magnetic member 92, the dice cup 30 is secured to the rotation head 46 for synchronous motion.

Figure 30:
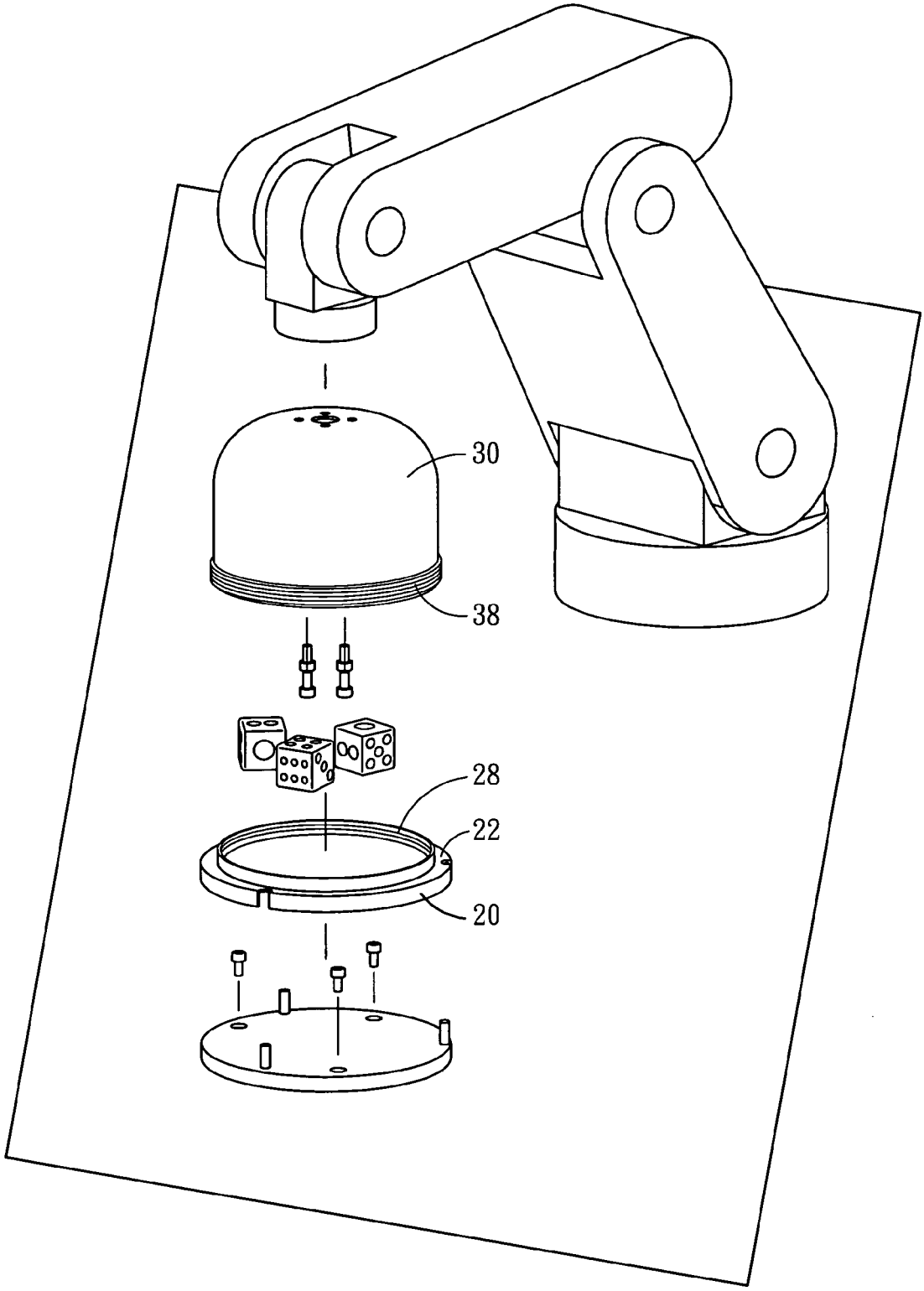
FIG. 30 is an exploded view of an automatic dice shaking apparatus in accordance with a sixth embodiment of the present invention

FIG. 30 illustrates an automatic dice shaking apparatus in accordance with a sixth embodiment of the present invention: The configuration and effects of this sixth embodiment are substantially similar to the aforesaid first embodiment with the exception that the cut seat 20 according to this sixth embodiment has an inner thread 28 disposed at the top wall 22, and the dice cut 30 according to this sixth embodiment has an outer thread 38 extending around the periphery of the bottom side thereof. By means of controlling the mechanical arm to rotate the dice cup 30 clockwise or counter-clockwise, the outer thread 38 is forced into engagement with or disengaged from the inner thread 28, and therefore the dice cup 30 and the dice seat 20 can be detachably fastened together.

Figure 31:
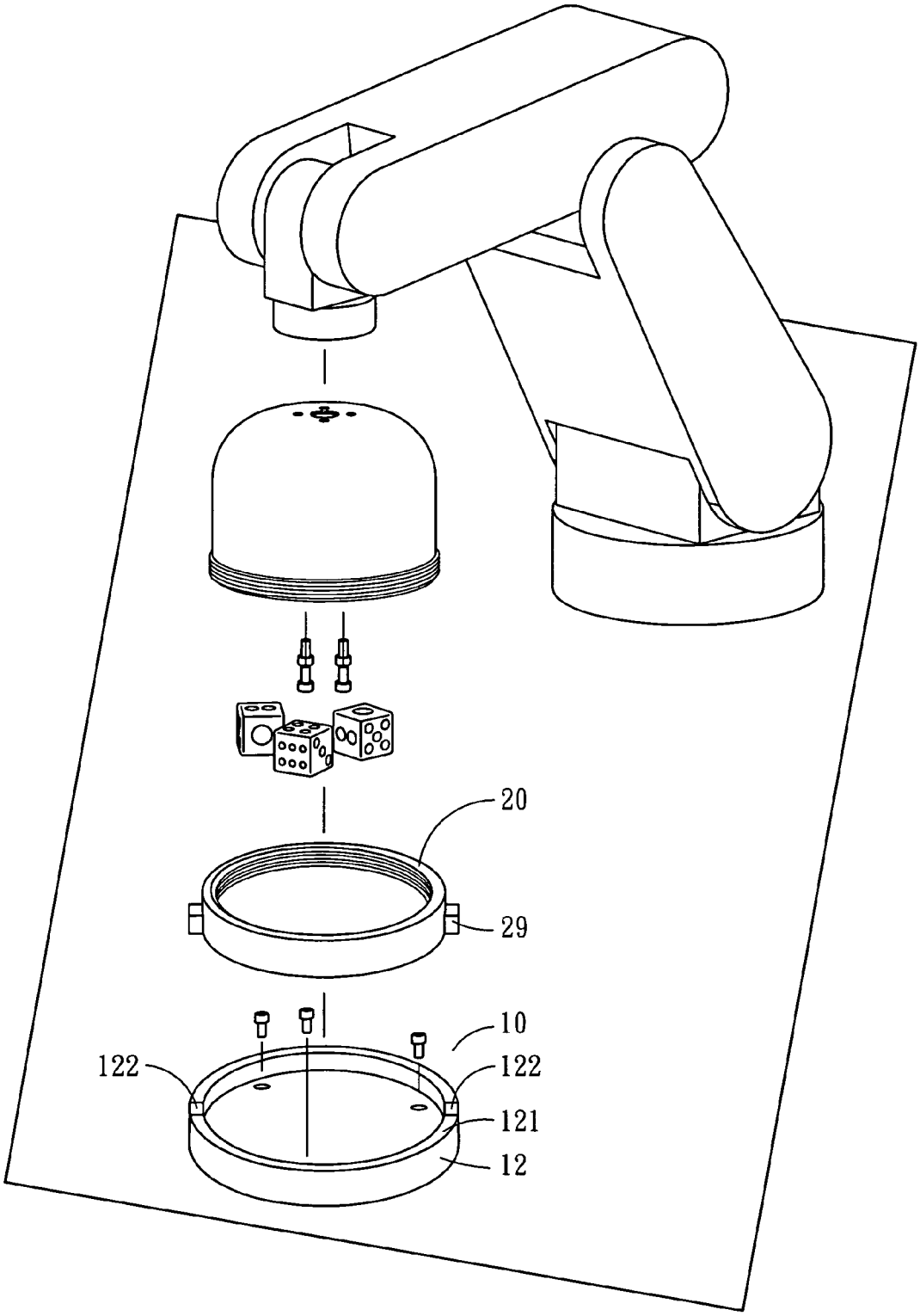
FIG. 31 is an exploded view of an automatic dice shaking apparatus in accordance with a seventh embodiment of the present invention

FIG. 31 illustrates an automatic dice shaking apparatus in accordance with a seventh embodiment of the present invention: The configuration and effects of this seventh embodiment are substantially similar to the aforesaid sixth embodiment with the exception that the positioning unit 10 according to this seventh embodiment is a disc member 12 that has an upright peripheral flange 121 and two locating notches 122 located on the upright peripheral flange 12 at two opposing sides and extending upwards; the dice seat 20 according to this seventh embodiment has two locating blocks 29 symmetrically protruded from the periphery and respectively vertically insertable into the locating notches 122. During installation, the locating blocks 29 are respectively engaged into the locating notches 122 to prohibit rotation of the dice seat 20 relative to the positioning unit 10, however the dice seat 20 can be disconnected from the positioning unit 10 when moved vertically relative to the positioning unit 10.

Figure 32:
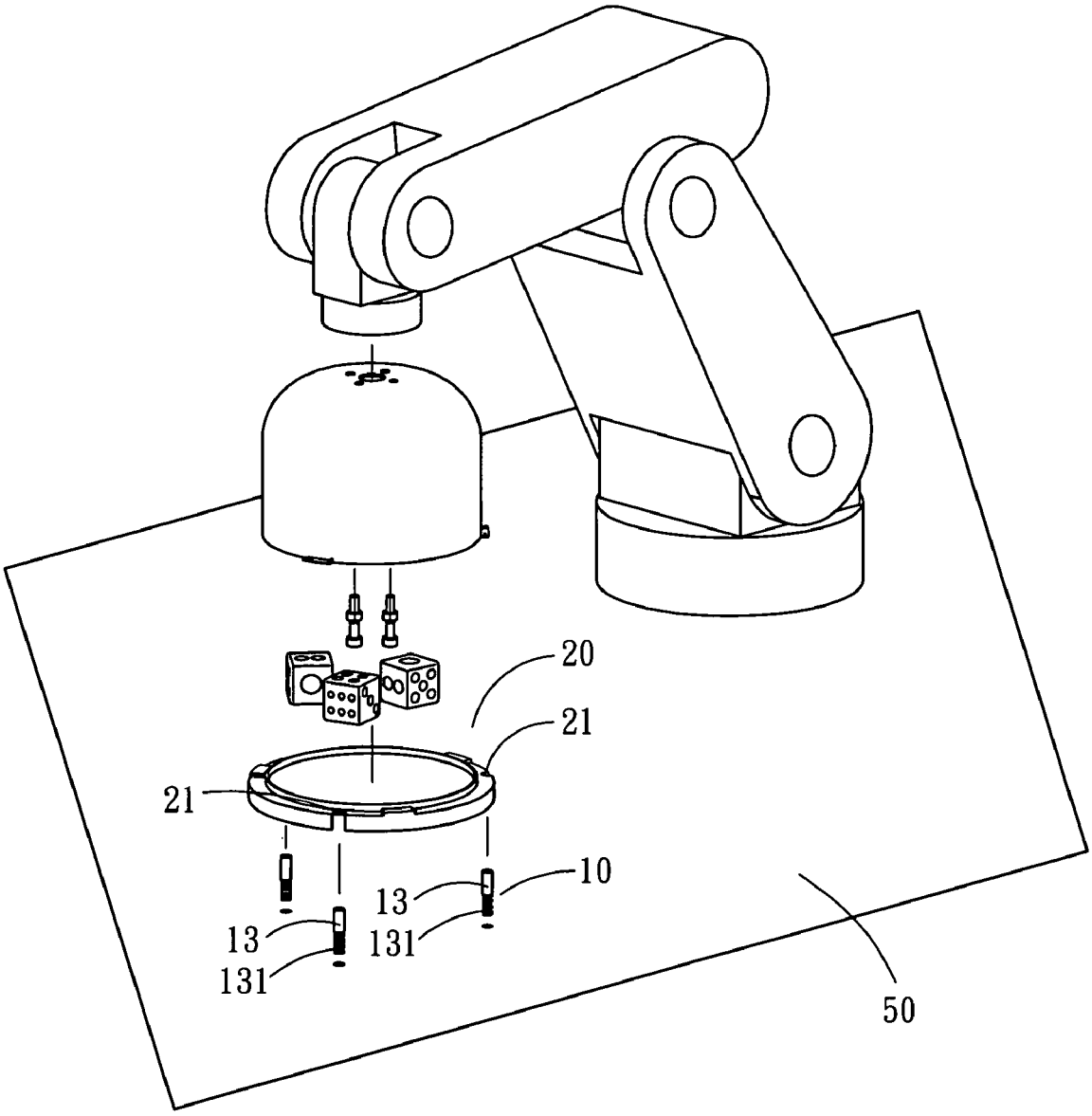
FIG. 32 is an exploded view of an automatic dice shaking apparatus in accordance with an eighth embodiment of the present invention.

FIG. 32 illustrates an automatic dice shaking apparatus in accordance with a eighth embodiment of the present invention: The configuration and effects of this eighth embodiment are substantially similar to the aforesaid first embodiment with the exception that the positioning unit 10 according to this eighth embodiment is comprised of three upright posts 13 equiangularly arranged on the plane 50. Each upright post 13 has a threaded portion 131 driven into the plane 50. The dice seat 20 has three positioning grooves 21 equiangularly spaced around the border and respectively attached to the upright posts 13. After engagement between the positioning grooves 21 and the upright posts 13, the dice seat 20 is prohibited from rotation relative to the plane 50, and can be moved vertically away from the positioning unit 10.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An automatic dice shaking apparatus comprising:

a positioning unit affixed to a plane;

a dice seat for carrying a plurality of dice, said dice seat being detachably connectable to said positioning unit and prohibited from rotation relative to said positioning unit after connection, said dice seat being vertically movable relative to said positioning unit and separable from said positioning unit after connection;

a dice cup detachably connectable to said dice seat, said dice cup defining with said dice seat an enclosed dice chamber;

a mechanical arm having a mount affixed to said plane, said mechanical arm being operable to make lifting, rotation and swinging actions, said mechanical arm having a front end connectable to said dice cup for enabling said dice cup to be lifted, rotated and swung by said mechanical arm;

wherein said mechanical arm is operable to connect said dice cup and said dice seat together, and then to separate combined said dice seat and said dice cup from said positioning unit, and then to shake combined said dice seat and said dice cup, and then to couple said dice seat to said positioning unit, and then to separate said dice cup from said dice seat.

2. The automatic dice shaking apparatus as claimed in claim 1, wherein said positioning unit comprises a base panel affixed to said plane, and at least two upright posts upwardly extending from a top surface of said base panel and equiangularly spaced around a border of said base panel; said dice seat comprises at least two positioning grooves equiangularly spaced around a periphery thereof and respectively coupled to said upright posts in such a manner that said dice seat is prohibited from rotation relative to said base panel.

3. The automatic dice shaking apparatus as claimed in claim 2, wherein the positioning unit comprises three said upright posts, and the dice seat comprises three said positioning grooves.

4. The automatic dice shaking apparatus as claimed in claim 2, wherein said dice cup comprises a plurality of retaining devices equiangularly spaced around a bottom side thereof; said dice seat comprises a plurality of retaining devices equiangularly arranged on a border area of a top wall thereof for securing the retaining devices of said dice cup respectively, each retaining device of said dice seat having a vertical portion perpendicularly extended from the top wall of said dice seat and a horizontal portion perpendicularly extended from a top side of said vertical portion and defining with the top wall of said dice seat a retaining gap for securing the associating retaining device of said dice cup.

5. The automatic dice shaking apparatus as claimed in claim 4, wherein the dice cup comprises three said retaining devices, and the dice seat comprises three said retaining devices.

6. The automatic dice shaking apparatus as claimed in claim 4, wherein each retaining device of said dice seat comprises a groove on a bottom wall of the horizontal portion thereof; each retaining device of said dice cup comprises a top protrusion protruded from a top wall thereof for engaging into the groove on the bottom wall of the horizontal portion of the associating retaining device of said dice seat.

7. The automatic dice shaking apparatus as claimed in claim 6, wherein each retaining device of said dice cup comprises a rear protrusion for stopping against the horizontal portion of the associating retaining device of said dice seat to prohibit displacement of the retaining device of said dice cup in the associating retaining gap of said dice seat.

8. The automatic dice shaking apparatus as claimed in claim 4, wherein the retaining devices of said dice seat has a longitudinal cross section that shows an inverted L shape.

9. The automatic dice shaking apparatus as claimed in claim 4, wherein said dice seat comprises an annular protrusion protruded from the top wall thereof for fitting into the inside of said dice cup.

10. The automatic dice shaking apparatus as claimed in claim 4, wherein said mechanical arm comprises a swing head and a rotation head pivotally connected to said swing head; said dice cup is connected to said rotation head.

11. The automatic dice shaking apparatus as claimed in claim 10, wherein said dice cup comprises a plurality of through holes on a top side thereof, and a plurality of screws respectively inserted through said through holes and driven into said rotation head to affix said dice cup to said rotation head.

12. The automatic dice shaking apparatus as claimed in claim 11, wherein each said screw comprises a threaded shank inserted through the associated through hole on said dice cup and driven into said rotation head, and a head disposed at one end of said threaded shank and stopped at one end of the associated through hole of said dice cup inside said dice cup.

13. The automatic dice shaking apparatus as claimed in claim 10, wherein said rotation head of said mechanical arm comprises a locating protrusion; said dice cup comprises a locating hole disposed at a top side thereof for receiving the locating protrusion of said rotation head.

14. The automatic dice shaking apparatus as claimed in claim 10, wherein said dice cup comprises a non-circular connection hole disposed at a top side thereof; said mechanical arm further comprises a connection device fastened to said rotation head and adapted for connecting said dice cup to said rotation head, said connection device comprises a connection portion that has a non-circular cross section fitting the non-circular connection hole of said dice cup and is inserted through the non-circular connection hole of said dice cup and a fastening element fastened to said connection portion inside said dice cup to secure said dice cup to said connection portion and said rotation head.

15. The automatic dice shaking apparatus as claimed in claim 10, wherein said dice cup comprises a plurality of retaining holes disposed at a top side thereof; said mechanical arm comprises a connection device affixed to a bottom side of said rotation head, said connection device comprises a plurality of retaining hooks equiangularly and downwardly extending from a bottom side thereof and respectively terminating in an outwardly protruding hook portion and respectively hooked in the retaining holes of said dice cup to secure said dice cup to said rotation head.

16. The automatic dice shaking apparatus as claimed in claim 10, wherein said dice cup comprises a top stub shank and a plurality of retaining holes around said top stub shank; said mechanical arm further comprises a connection device affixed to a bottom side of said rotation head, said connection device having a plurality of retaining hooks equiangularly and downwardly extending from a bottom side thereof and respectively terminating in a respective inwardly protruding hook portion and respectively hooked in the retaining holes of said dice cup to secure said dice cup to said rotation head.

17. The automatic dice shaking apparatus as claimed in claim 10, wherein said rotation head of said mechanical arm has a bottom side fixedly provided with a first magnetic member; said dice cup has a top side fixedly provided with a second magnetic member that is fastened to said first magnetic member by means of magnetic attraction.

18. The automatic dice shaking apparatus as claimed in claim 2, wherein said dice seat comprises an inner thread provided at a top wall thereof; said dice cup comprises an outer thread extending around a bottom side thereof for threading into engagement with said inner thread to detachably secure said dice cup to said dice seat.

19. The automatic dice shaking apparatus as claimed in claim 18, wherein said positioning unit is a disc member having an upright peripheral flange and at least one locating notch located on said upright peripheral flange; said dice seat comprises at least one block protruded from the periphery thereof and vertically insertable into the locating notches of said positioning unit to have said dice seat be vertically detachably secured to said positioning unit.

20. The automatic dice shaking apparatus as claimed in claim 1, wherein said positioning unit is comprised of three upright posts; said dice seat comprises three positioning grooves around the periphery thereof and respectively vertically attached to said upright posts to have said dice seat be vertically detachably secured to said positioning unit.

21. The automatic dice shaking apparatus as claimed in claim 20, wherein each said upright post has a threaded portion driven into said plane.

* * * * *